US007207493B2

(12) United States Patent
Dunn et al.

(10) Patent No.: US 7,207,493 B2
(45) Date of Patent: Apr. 24, 2007

(54) DOCUMENT STACKER APPARATUS AND METHOD OF STACKING DOCUMENTS

(75) Inventors: Frank B. Dunn, Waterloo (CA); Anthony J. Boon, Kitchener (CA)

(73) Assignee: NCR Corporation, Dayton, OH (US)

( * ) Notice: Subject to any disclaimer, the term of this patent is extended or adjusted under 35 U.S.C. 154(b) by 176 days.

(21) Appl. No.: 11/016,788

(22) Filed: Dec. 20, 2004

(65) Prior Publication Data

US 2006/0131421 A1 Jun. 22, 2006

(51) Int. Cl.
*G06K 13/00* (2006.01)

(52) U.S. Cl. ..... 235/475; 235/379; 271/3.01

(58) Field of Classification Search ..... 235/475, 235/477; 902/8; 271/3.01, 3.14
See application file for complete search history.

(56) References Cited

U.S. PATENT DOCUMENTS 3,606,312 A 9/1971 Mens et al.
4,640,505 A 2/1987 Placke et al.
4,662,626 A 5/1987 Shores et al.
5,199,700 A * 4/1993 Fairey et al. ..... 271/209

* cited by examiner

*Primary Examiner*—Seung Ho Lee
(74) *Attorney, Agent, or Firm*—Michael Chan

(57) ABSTRACT

A document is cupped at a first time to stiffen and straighten the document before the document is stacked in the interior chamber of a document stacker. The cupped document is cupped at a second time which is different from the first time to maintain the document stiff and straight as the document is being stacked in the interior chamber of the document stacker so as to reduce the chance of a stacking defect from occurring when a succeeding document is subsequently stacked on top of the document. A trailing edge of the document is engaged to urge the trailing edge of the document in a direction away from direction of movement of the document into the interior chamber of the document stacker so as to prevent a succeeding document which is to be subsequently stack on top of the document from stacking out of sequence relative to the document. The document is frictionally engaged as the document is being stacked in the interior chamber of the document stacker to prevent the document from moving too far into the interior chamber so as to allow the trailing edge of the document to be engaged and urged in the direction away from direction of movement of the document into the interior chamber of the document stacker.

13 Claims, 21 Drawing Sheets

DOCUMENT STACKER APPARATUS AND METHOD OF STACKING DOCUMENTS

BACKGROUND OF THE INVENTION

The present invention relates to stacking documents in a self-service environment, such as stacking checks which have been deposited at a check depositing automated teller machine (ATM), and is particularly directed to a document stacker apparatus and method of stacking documents such that the documents are stacked in sequence relative to each other.

In a typical known check depositing ATM, a user is allowed to deposit a check (without having to place the check in any deposit envelope) in a publicly accessible, unattended environment. To deposit a check, the user inserts a user identification card through a user card slot at the check depositing ATM, enters the amount of the check being deposited, and inserts the check to be deposited through a check slot. A check transport mechanism receives the inserted check and transports the check in a forward direction along a check transport path to a number of locations within the ATM to process the check.

If the check is not accepted for deposit, the check transport mechanism transports the check in a reverse direction along the check transport path to return the check to the user via the check slot. If the check is accepted for deposit, the amount of the check is deposited into the user's account and the check is transported to a document storage bin within the ATM. An endorser printer prints an endorsement onto the check as the check is being transported to and stored in the storage bin. Checks in the storage bin within the ATM are periodically picked up and physically transported via courier to a back office facility of a financial institution for further processing.

When the check is transported to the storage bin, the condition of the check may cause the check to crumple or curl up as the check moves into the storage bin. The tendency of the check to crumple or curl up as the check moves into the storage bin may depend upon how empty or full the storage bin is at the time the check is moving into the storage bin. The tendency of the check to crumple or curl up usually increases as the storage bin bercomes fuller.

A number of problems may be created when the check crumples or curls up as the check moves into the storage bin. One problem is that the effective storage capacity of the storage bin may be reduced. The effective storage capacity of the storage bin may be reduced since a crumpled and/or curled up check usually takes up more space in the storage bin than a check which is neither crumpled nor curled up. Another problem is that the order in which checks were received in the storage bin may be lost. When the order is lost, additional time is usually required later at the back office facility of the financial institution to sort the checks back into the order in which the checks were received in the storage bin. It would be desirable to provide a type of storage bin in which deposited checks are reliably stacked in the order received, and in which the capacity of the storage bin is more fully utilized independent of the conditions of the deposited checks.

SUMMARY OF THE INVENTION

In accordance with one aspect of the present invention, a method of stacking documents in an interior chamber of a document stacker comprises cupping a document at a first time to stiffen and straighten the document before the document is stacked in the interior chamber, and cupping the cupped document at a second time which is different from the first time to maintain the document stiff and straight as the document is being stacked in the interior chamber and thereby to reduce the chance of a stacking defect from occurring when a succeeding document is subsequently stacked on top of the document. The method may further comprise engaging a trailing edge of the document to urge the trailing edge of the document in a direction away from direction of movement of the document into the interior chamber and thereby to prevent a succeeding document which is to be subsequently stacked on top of the document from stacking out of sequence relative to the document. The method may also comprise frictionally engaging the document as the document is being stacked in the interior chamber to prevent the document from moving too far into the interior chamber and thereby to allow the trailing edge of the document to be engaged and urged in the direction away from direction of movement of the document into the interior chamber.

In accordance with another aspect of the present invention, a method of stacking documents in an interior chamber of a document stacker comprises cupping a document to stiffen and straighten the document before the document is transported into the interior chamber to be stacked in the interior chamber, and cupping the cupped document to maintain the document stiff and straight as the document is being transported into the interior chamber and stacked in the interior chamber and thereby to reduce the chance of a succeeding document which is subsequently transported into the interior chamber from crumpling into the document. The method may further comprise engaging a trailing edge of the document to urge the trailing edge of the document in a direction away from direction of movement of the document into the interior chamber and thereby to prevent a leading edge of the succeeding document which is to be subsequently transported into the interior chamber from crumpling into the trailing edge of the document. The method may also comprise frictionally engaging the document as the document is being transported into the interior chamber to prevent the document from moving too far into the interior chamber and thereby to allow the trailing edge of the document to be engaged and urged in the direction away from direction of movement of the document into the interior chamber.

In accordance with yet another aspect of the present invention, a document stacker apparatus comprises means defining an interior chamber into which documents can be stacked and through which an axis extends from an upstream end of the interior chamber to a downstream end of the interior chamber. The document stacker apparatus further comprises first cupping means for cupping a document to stiffen and straighten the document before the document is transported into the interior chamber to be stacked in the interior chamber, and second cupping means for cupping the cupped document to maintain the document stiff and straight as the document is being transported into the interior chamber from the upstream end of the interior chamber towards the downstream end of the interior chamber and stacked in the interior chamber so as to reduce the chance of a stacking defect from occurring when a succeeding document is subsequently transported into the interior chamber and stacked on top of the document. The document stacker apparatus may further comprise engaging means for engaging a trailing edge of the document to urge the trailing edge of the document in a direction away from the downstream end of the interior chamber so as to prevent a succeeding document which is to be subsequently transported into the interior chamber from stacking out of sequence relative to the document. The engaging means may include (i) a flapper roller rotatable about its longitudinal central axis, and (ii) a number of flapper members disposed circumferentially around the flapper roller such that the flapper members extend in a direction transverse to the longitudinal central axis of the flapper roller. The document stacker apparatus may further comprise biasing means for co-operating with the second cupping means to provide friction for engaging the document as the document is being transported into the interior chamber to prevent the document from moving too far into the interior chamber so as to enable the engaging means to engage the trailing edge of the document and urge the trailing edge of the document in the direction away from the downstream end of the interior chamber. The biasing means may include (i) a platform member on which documents are supported when the documents are stacked in the interior chamber, and (ii) a number of resilient members disposed beneath the platform member such that the resilient members bias the platform member and any documents supported thereon towards the pair of slack wires to bias the document which is being transported onto the stack of documents against the pair of slack wires to frictionally engage the document as the document is being transported into the interior chamber to be stacked. The first cupping means includes a pair of cupping rollers having a common longitudinal central axis which extends transverse to the axis of the interior chamber. The second cupping means may include a pair of slack wires disposed between the pair of cupping rollers and extending along the axis of the interior chamber within the interior chamber such that (i) the pair of cupping rollers cup the document to stiffen and straighten the document before the document is transported into the interior chamber, and (ii) the pair of slack wires subsequently cup the document to maintain the document stiff and straight as the document is being transported into the interior chamber.

In accordance with still another aspect of the present invention, a method of operating an automated teller machine (ATM) comprises receiving a check from an ATM customer, reading a magnetic ink character recognition (MICR) codeline from the check, endorsing the check, transporting the endorsed check to a stacker bin, cupping the check to stiffen and straighten the check as the check is being transported into the stacker bin, and cupping the cupped check to maintain the check stiff and straight as the check is being stacked on top of other checks already stacked in the stacker bin so as to reduce the chance of a succeeding check which is subsequently transported into the stacker bin from stacking out of sequence. The method may further comprise flicking a trailing edge of the check to urge the trailing edge of the check in a direction away from direction of movement of the check into the stacker bin so as to prevent a leading edge of the succeeding check which is to be subsequently transported into the stacker bin from either crumpling into the trailing edge of the check or stacking underneath the check. The method may also comprise frictionally engaging the check as the check is being transported into the stacker bin to prevent the check from moving too far into the stacker so as to allow the trailing edge of the check to be flicked and urged in the direction away from direction of movement of the check into the stacker bin.

BRIEF DESCRIPTION OF THE DRAWINGS

These and other aspects of the present invention will be apparent from the following specific description, given by way of example, with reference to the accompanying drawings, in which.

DETAILS OF THE INVENTION

The present invention relates to stacking documents in a self-service environment, such as stacking checks which have been deposited at a check depositing automated teller machine (ATM), and is particularly directed to a document stacker apparatus and method of stacking documents such that the documents are stacked in sequence relative to each other.

Figure 1:
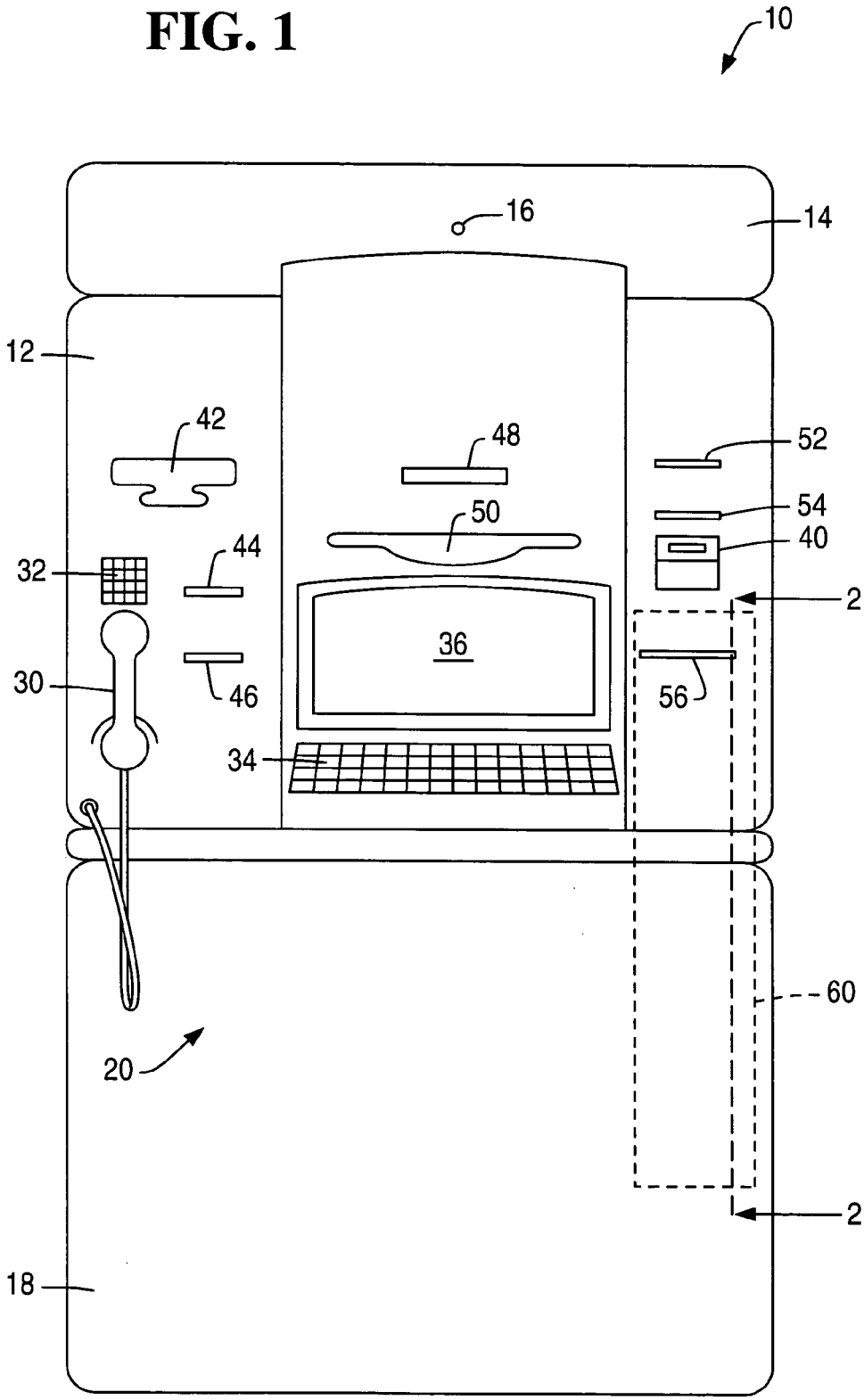
FIG. 1 is a pictorial diagram of an image-based check depositing ATM embodying the present invention.

Referring to FIG. 1, a self-service terminal 10 in the form of an image-based check depositing ATM is illustrated. The check depositing ATM 10 comprises a fascia 12 pivotably coupled to a chassis (not shown), an upper panel 14 mounted to the chassis and defining an aperture 16 through which a camera (not shown) images a user of the ATM 10, and a lower panel 18 hingeably coupled to the chassis so that the lower panel can be opened to reveal a safe (not shown) mounted in the chassis. When the lower panel 18 is open, the fascia 12 can be pivoted upwards to reveal ATM modules mounted within the chassis.

The fascia 12 and lower panel 18 provide a user interface 20 for allowing a user to execute a transaction. The fascia 12 includes a handset 30 and a telephone keypad 32 for allowing a user to contact a remote operator (not shown) typically located in a call center (not shown). The fascia 12 also includes an encrypting keyboard 34 for allowing a user to enter transaction details, and a display 36 for presenting screens to a user. The fascia 12 also defines a number of slots for receiving and dispensing media items, and a tray 40 into which coins can be dispensed. The slots include a money order printer slot 42, a bunch note input slot 44, a bunch note exit slot 46, a statement output slot 48, a cash dispense slot 50, a card reader slot 52, a card issue slot 54, and a check input/output slot 56. The slots 42 to 56 and tray 40 are arranged so that when the fascia 12 is closed, the slots and tray align with corresponding ATM modules mounted within the ATM's chassis (not shown). The user interface features described above are all provided on an NCR PERSONAS (™) 5878 financial services center ATM, available from NCR Financial Solutions Group Limited, Discovery Centre, 3 Fulton Road, Dundee, DD2 4SW, Scotland.

Figure 2:
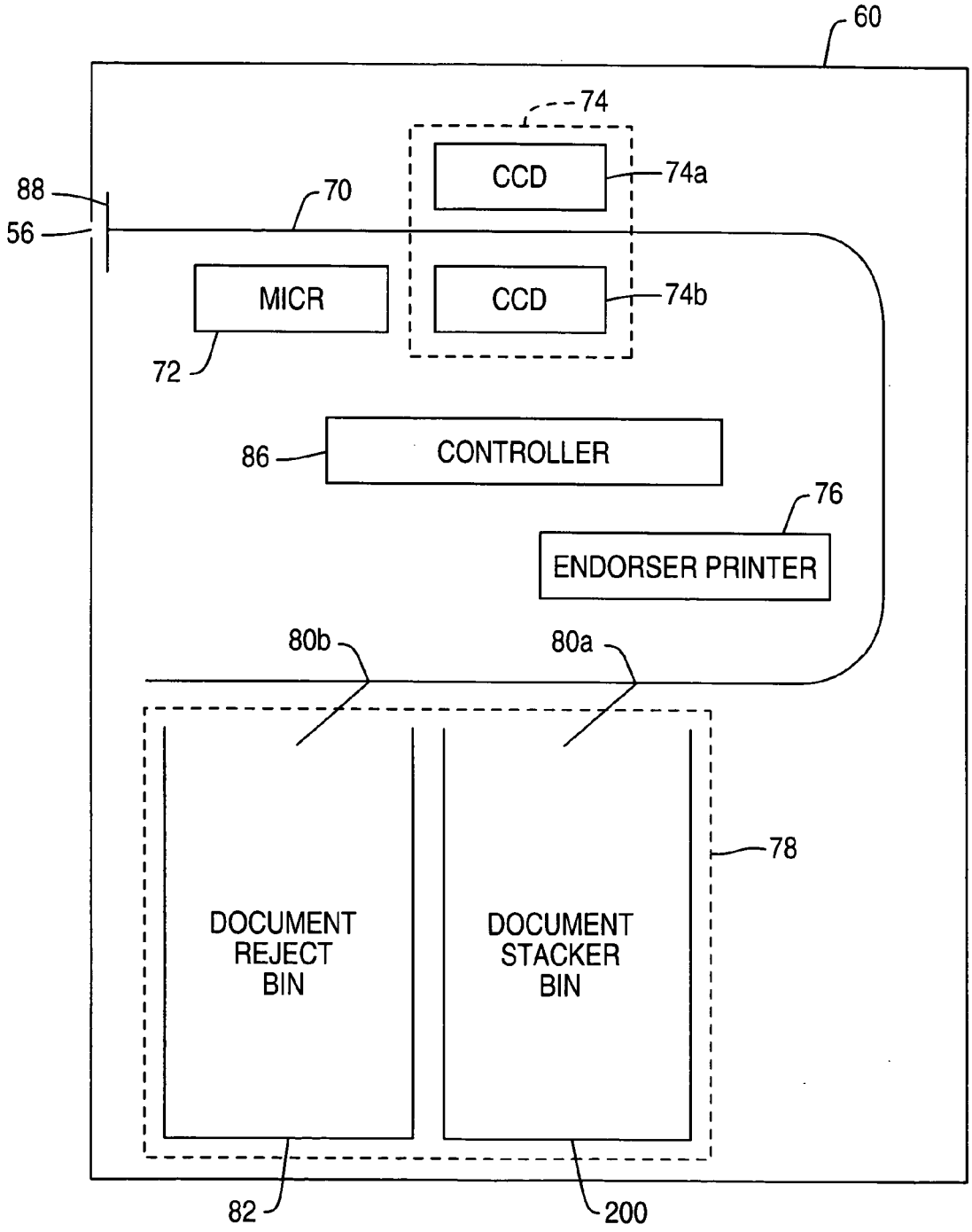
FIG. 2 is a simplified schematic sectional diagram, taken approximately along line 2—2 in FIG. 1, and showing a part (the check processing module) of the ATM of FIG. 1.
Figure 3:
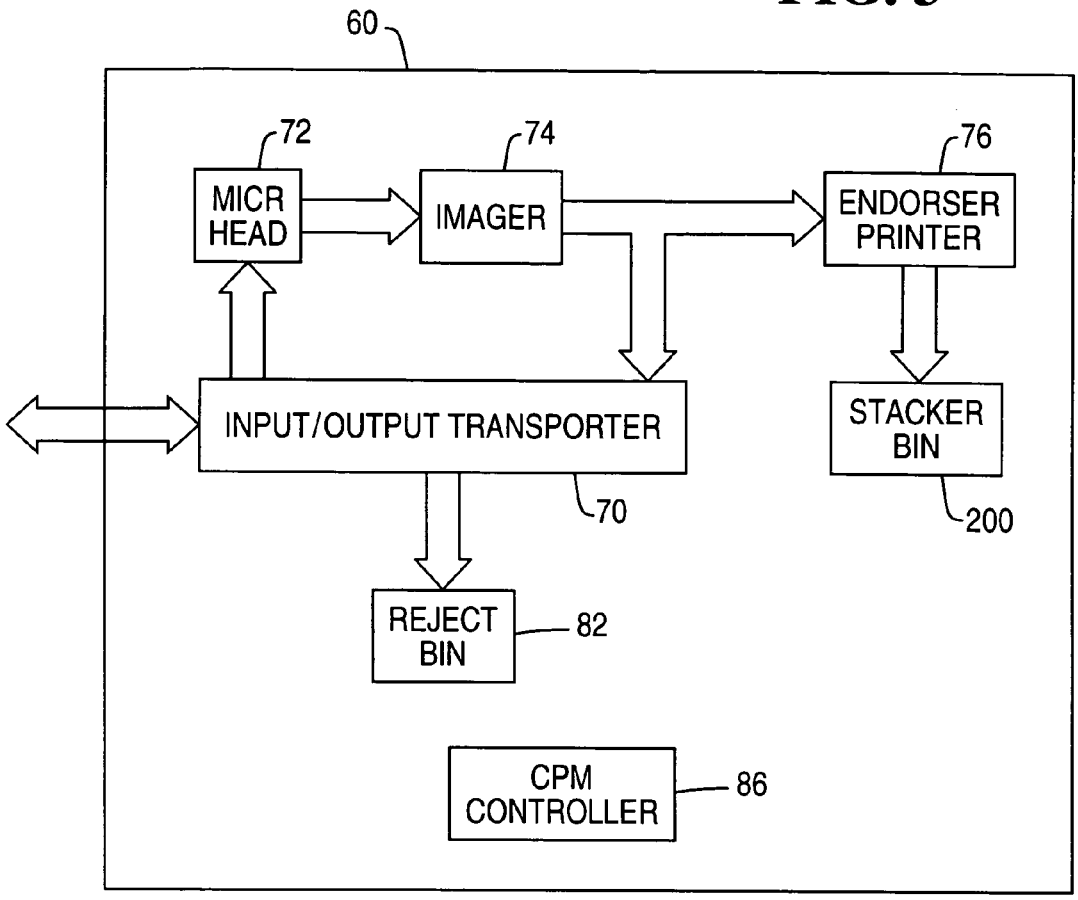
FIG. 3 is a block diagram of the check processing module of FIG. 2.

A check processing module (CPM) 60 will now be described with reference to FIG. 2 and FIG. 3. FIG. 2 is a simplified schematic sectional diagram (along line 2—2 in FIG. 1) showing part of the fascia 12 and lower panel 18, and the main parts of the CPM 60. FIG. 3 is a block diagram illustrating the main elements in the CPM 60. The CPM 60 is a modified version of a conventional check processing module, such as the check processing module provided with the PERSONAS (™) 5878 NCR ATM. The CPM 60 comprises a check input/output transport mechanism 70 including an alignment mechanism for aligning a check, a magnetic ink recognition character (MICR) head 72 for reading magnetic details on a code line of a check, an imager 74 including an upper 74*a* and lower 74*b* CCD camera for capturing an image of each side of a check (front and rear), and a printer 76 for endorsing a check.

The CPM 60 further comprises a bin module 78 including a document stacker bin 200 for storing processed checks, and a document reject bin 82 for storing rejected checks. The transport mechanism 70 includes two divert gates 80*a*, 80*b* for diverting checks to either the document stacker bin 200 or the document reject bin 82. The elements other than the document stacker bin 200 are conventional and will not be described in detail herein. The structure and operation of the document stacker bin 200 will be described in detail later. The CPM 60 also includes a controller 86 for controlling the operation of the elements within the CPM 60. The CPM 60 also includes an entrance shutter 88 for opening and closing the check input/output slot 56.

Figure 4:
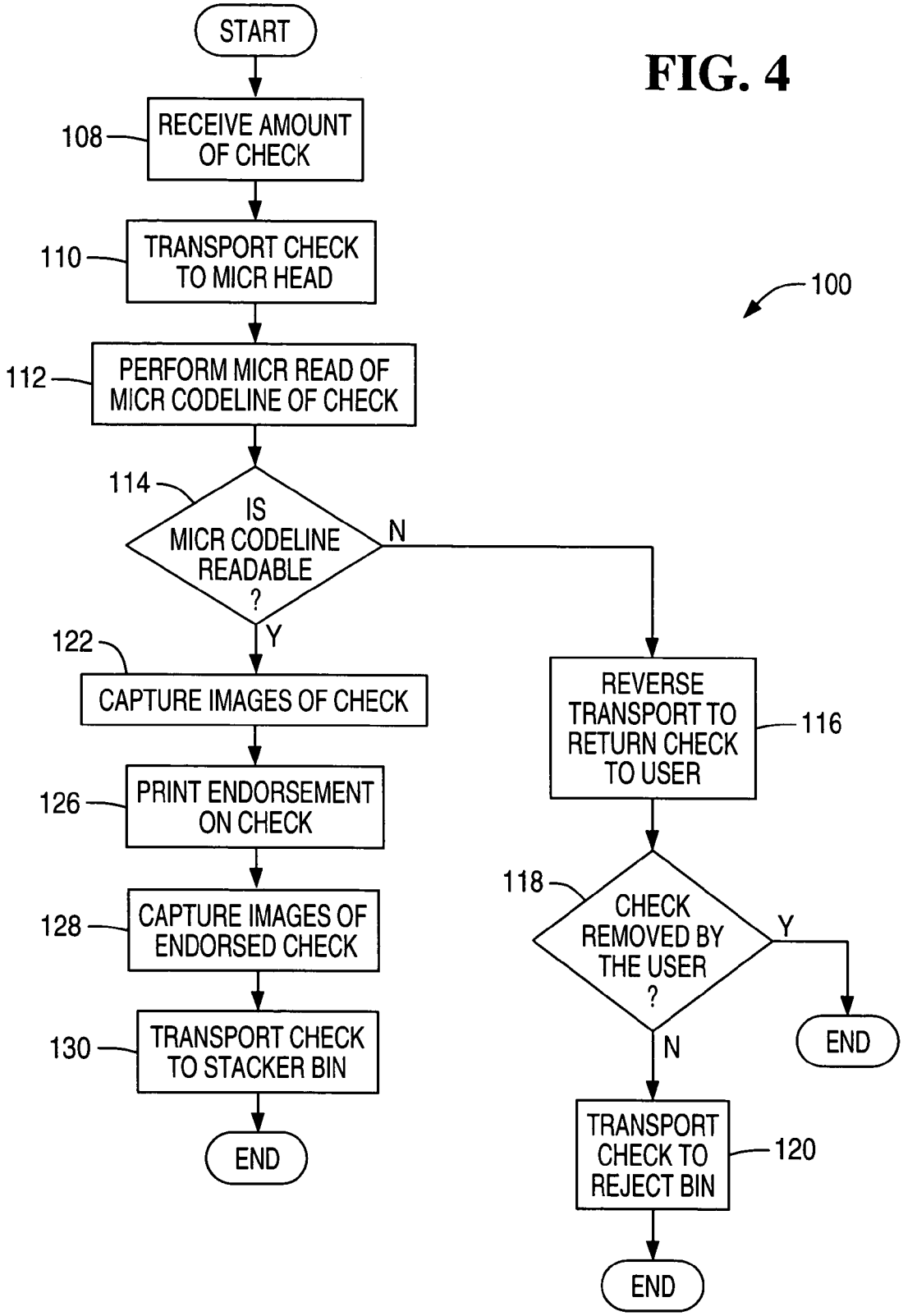
FIG. 4 is a flowchart illustrating steps involved in a check depositing operation.

A typical depositing transaction will now be described with reference to FIG. 4 which is a flowchart 100 illustrating the steps involved in a check depositing transaction, and also with reference to FIGS. 1 to 3. In this transaction, the user enters user identification card into the card reader slot 52, selects "check depositing" from a list of transaction options presented on the display 36, enters the amount of the check via the keyboard 34, and inserts the check to be deposited through the check input/output slot 56. The controller 86 receives the amount of the check (step 108), and opens the slot shutter 88. The transport mechanism 70 receives the check and transports the received check (step 110) to the MICR head 72 where the MICR codeline on the check is read (step 112).

A determination is made (step 114) as to whether the MICR codeline can be read from the check. If the MICR codeline data from the check is unreadable as determined in step 114, then a check return operation is initiated. When this occurs, the transport mechanism 70 reverses the direction of transport (step 116) to convey the check to the check input/output slot 56 to return the check to the user via the check input/output slot. The controller 86 may monitor the slot 56 to ensure that the check has been removed by the user (step 118). If the user has not removed the check within a predetermined time period, the check is retracted and conveyed to the document reject bin 82 (step 120).

However, if the MICR codeline data from the check is readable as determined in step 114, then the transport mechanism 70 transports the check to the imager 74, where both sides of the check are imaged (step 122). The printer 76 prints endorsement data onto the check (step 126). The check is then transported to the imager 74 to image the endorsed check (step 128) before it is transported to the document stacker bin 200 (step 130) for subsequent collection and further processing. Although the above describes both steps 122 and 128 being performed, it is conceivable that only one of these steps be performed. Preferably, step 122 is performed, and step 128 is optionally performed.

Figure 5:
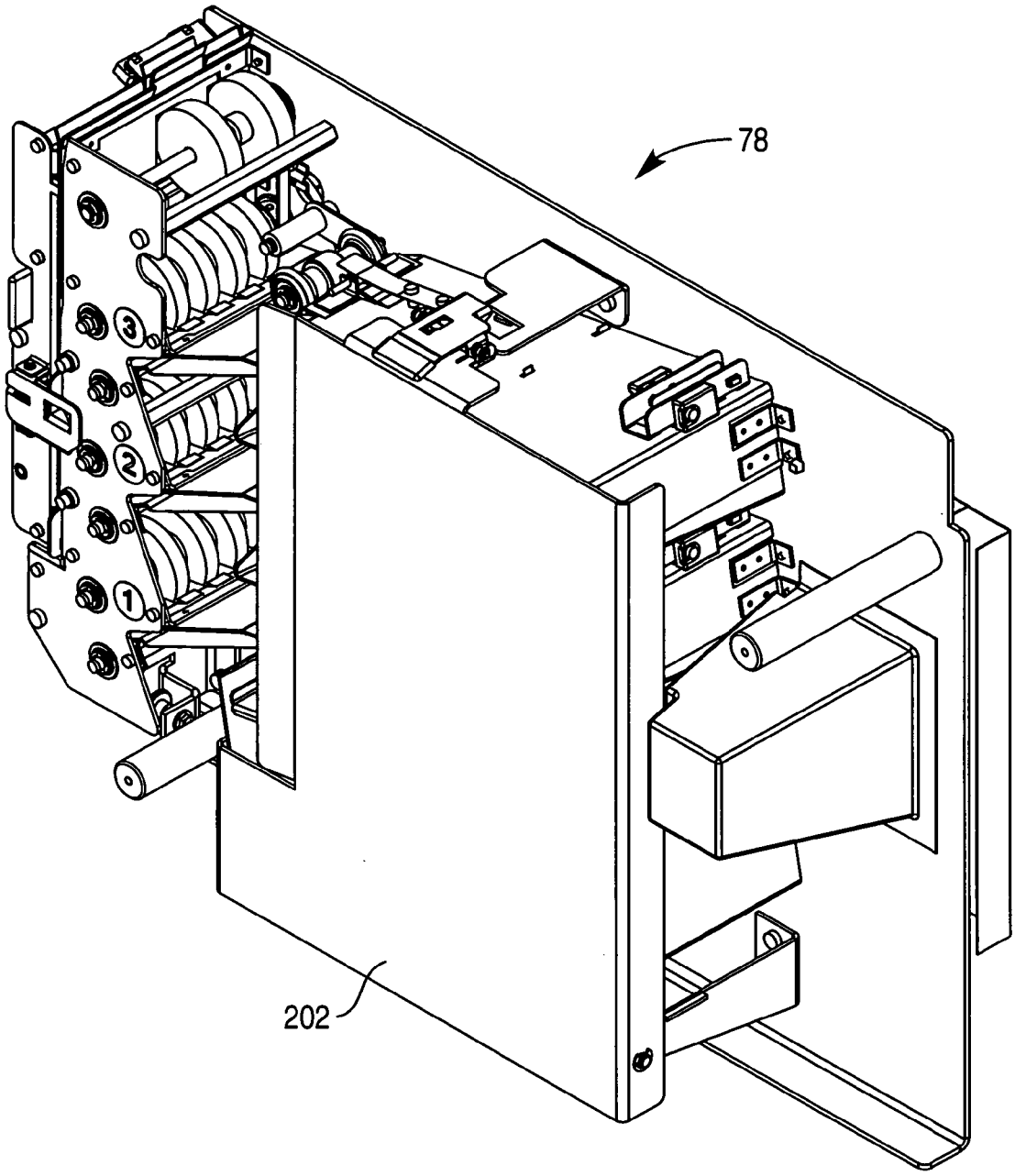
FIG. 5 is perspective view of a bin module which includes a document stacker bin used in the ATM of FIG. 1.
Figure 6:
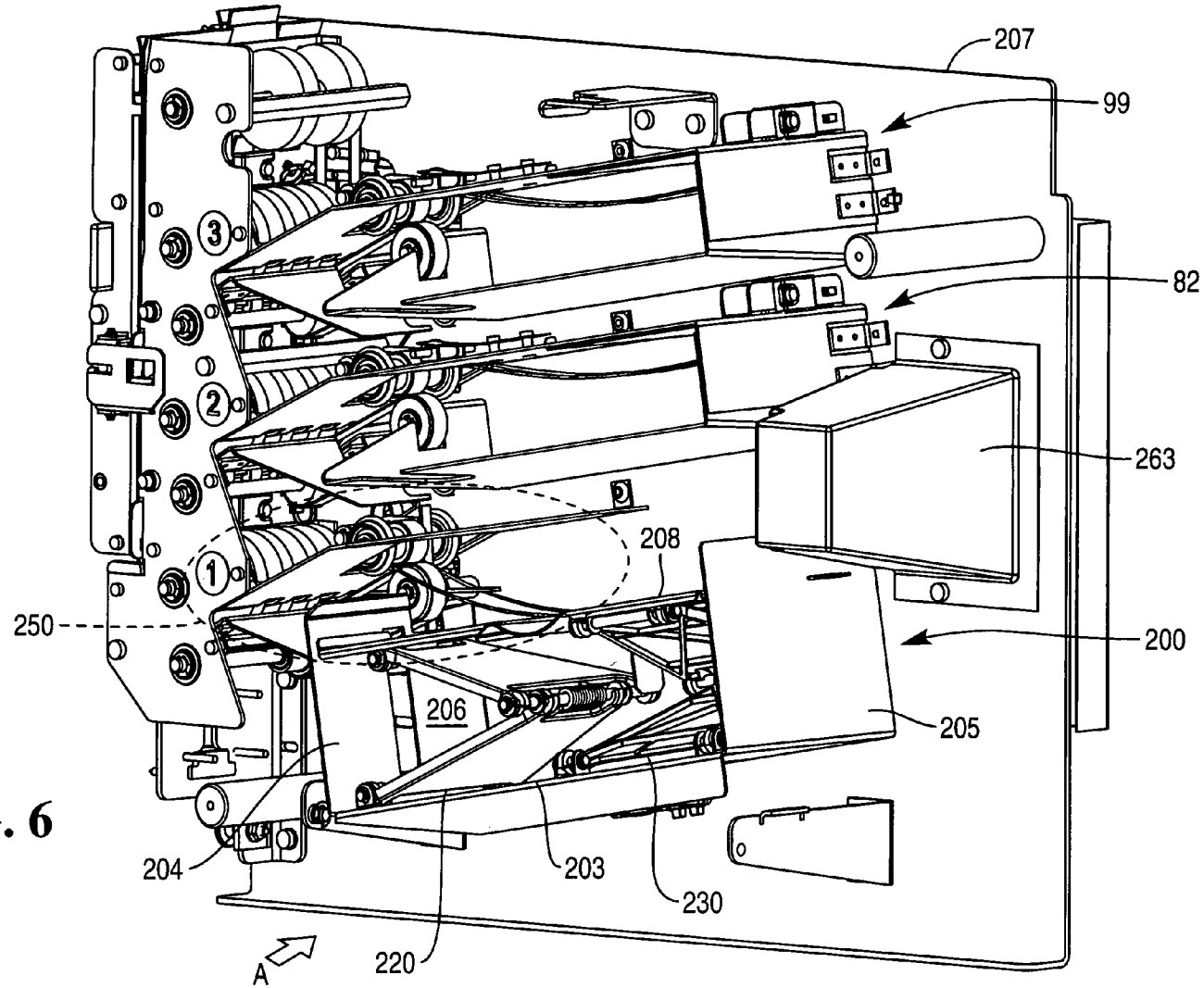
FIG. 6 is a view similar to FIG. 5, and showing a door panel removed to expose the document stacker bin.

Referring to FIG. 5, the bin module 78 is illustrated. The bin module 78 includes a removable door panel 202 which, when removed as shown in FIG. 6, allows access to the document reject bin 82 and the document stacker bin 200. As shown in FIG. 6, the stacker bin 200 is located beneath the reject bin 82 which, in turn, is located beneath another bin 99 which may be a "miscellaneous documents" type of a bin, for example. The bin 99 and the reject bin 82 are of known construction and operation and, therefore, will not be described. Although the above describes the stacker bin 200 as being located below the other two bins, it is contemplated that the stacker bin 200 may be above the other two bins or between the other two bins. It is also contemplated that the stacker bin 200 may be located with only one other bin, or just by itself with no other bin.

Figure 7:
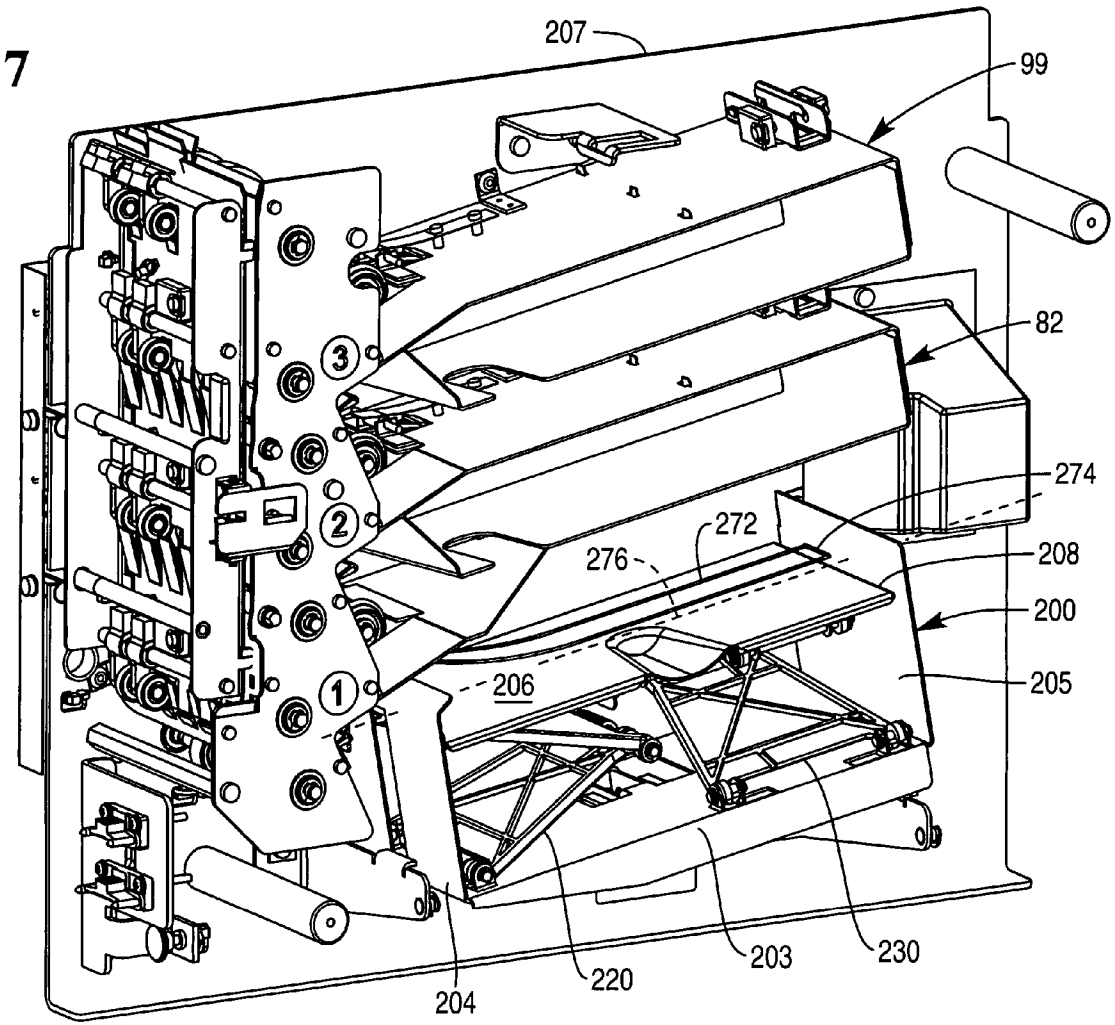
FIG. 7 is a perspective view looking generally from the left-side of FIG. 6.
Figure 8:
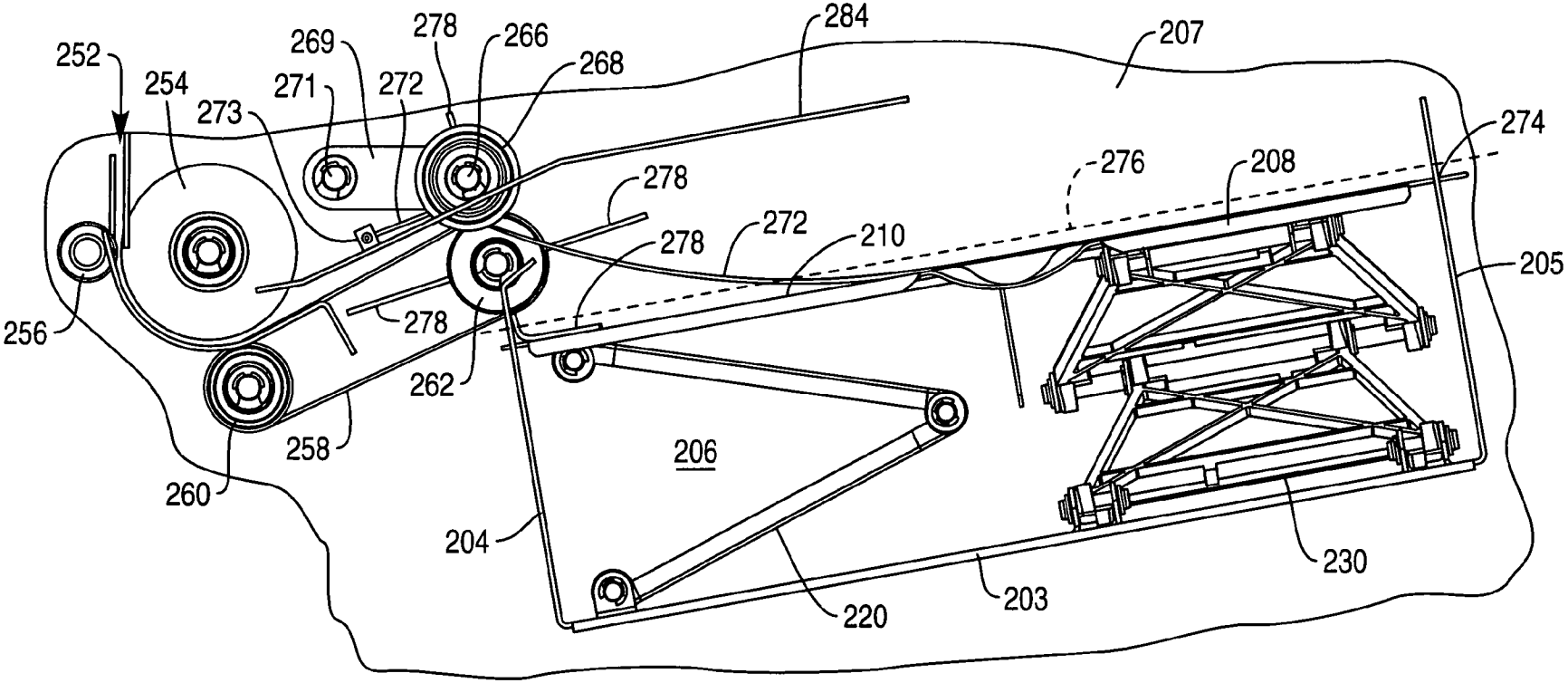
FIG. 8 is an elevational view looking approximately in the direction of arrow A in FIG. 6, and showing an enlargement of the document stacker bin with parts removed.

The stacker bin 200 embodies the present invention and will be described in detail herein. FIG. 7 is a different perspective view from the left-side (as viewed looking at FIG. 6) of FIG. 6 to illustrate certain details not visible in FIG. 6. FIG. 8 is an elevational view looking approximate in the direction of arrow A in FIG. 6, and showing an enlargement of the stacker bin 200 of FIG. 6 with parts removed so that certain parts can be more clearly illustrated. As shown in FIGS. 6–8, the stacker bin 200 includes a bottom wall portion 203, and a pair of endwall portions 204, 205 which together form an interior chamber 206 in which a platform member 208 is disposed on a pair of biasing members 220, 230. Similarly, a portion of a base plate 207 functions as a sidewall portion which forms the interior chamber 206. A portion of the removable door panel 202 (shown only in FIG. 5) functions as another sidewall portion which forms the interior chamber 206. For simplicity, the interior chamber 206 will be described in the remaining figures hereinafter with the door panel 202 removed.

Figure 9:
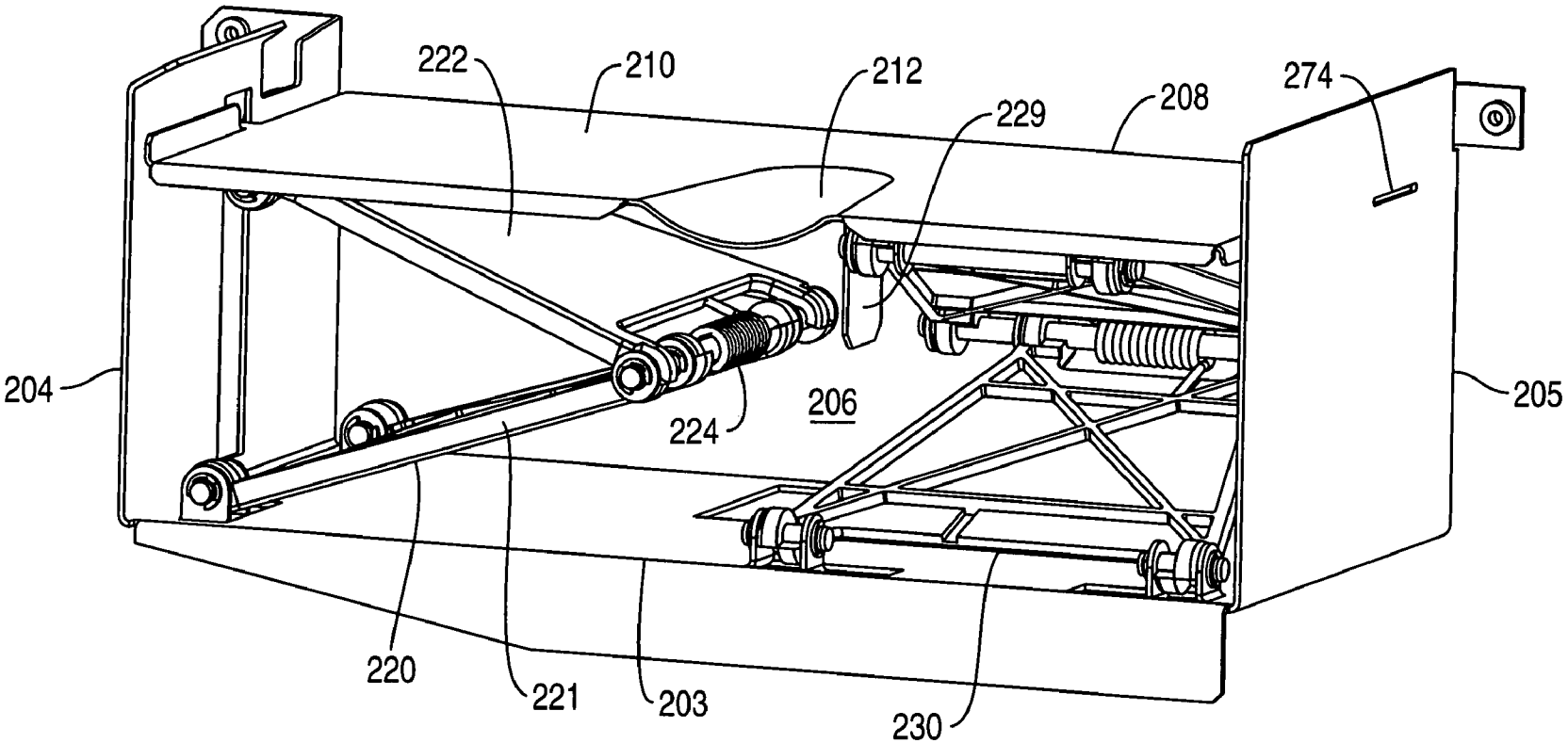
FIG. 9 is an enlarged view of a portion of FIG. 6 to better illustrate certain parts.
Figure 10:
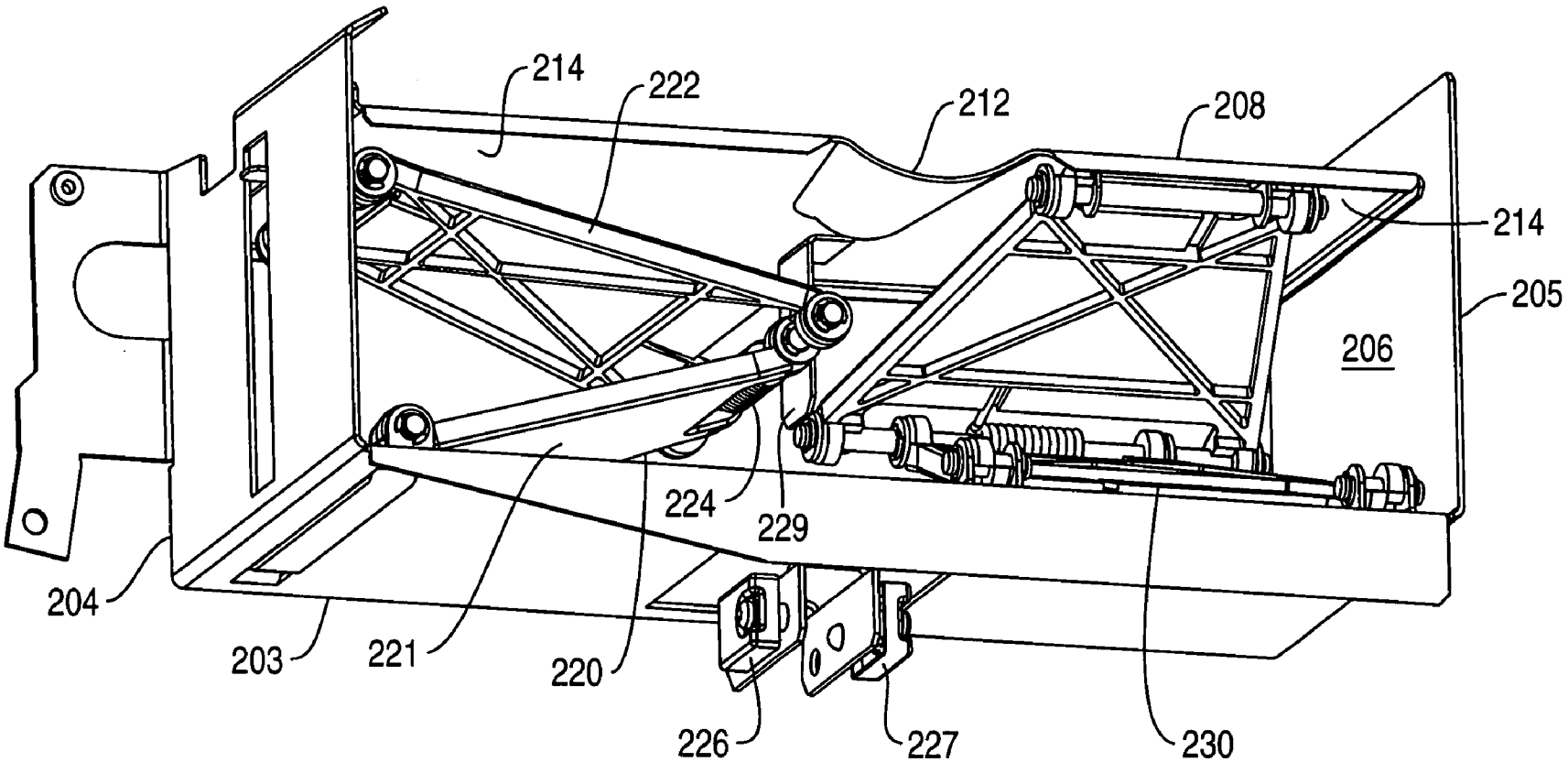
FIG. 10 is a perspective view looking generally from the lower left-side of FIG. 9.

The platform member 208 and the pair of biasing members 220, 230 are better shown in the enlarged view of FIG. 9. FIG. 10 is a different perspective view from the left-side (as viewed looking at FIG. 9) of FIG. 9 to illustrate certain details not visible in FIG. 9. As shown in FIGS. 9 and 10, the platform member 208 has a top major surface 210 on which checks transported into the interior chamber 206 can be stacked. The platform member 208 also has an indented surface 212 disposed approximately in a central area of the top major surface 210. The indented surface 212 allows a user to place a finger underneath a stack of documents which is stacked on the top major surface 210 so that the user can easily pick up and remove the stack of documents. A projecting member 229 is fixedly attached to the underside of the platform member 208.

The biasing members 220, 230 shown in FIGS. 9 and 10 are of similar structure and operation. For simplicity, only the biasing member 220 will be described in detail. The biasing member 220 includes a first reinforced plate 221, a second reinforced plate 222, and a helical spring 224 which interconnects the first and second reinforced plates to form a V-shape structure as shown. The helical spring 224 provides a spring force which tends to open up (i.e., expand) the V-shape structure. The biasing member 220 is adjacent to the endwall portion 204 and is interconnected between the bottom wall portion 203 and a bottom major surface 214 (FIG. 10) of the platform member 208. The biasing member 230 is adjacent to the endwall portion 205 and is also interconnected between the bottom wall portion 203 and the bottom major surface 214 of the platform member 208. The biasing member 230 is attached in a direction which is transverse to the direction in which the biasing member 220 is attached.

As shown in FIG. 10, a light source such as a light emitting diode (LED) 226 is disposed underneath the bottom wall portion 203. A sensor such as a phototransistor sensor 227 is also disposed underneath the bottom wall portion 203. The sensor 227 faces the LED 226 and receives light emitted by the LED.

Figure 11:
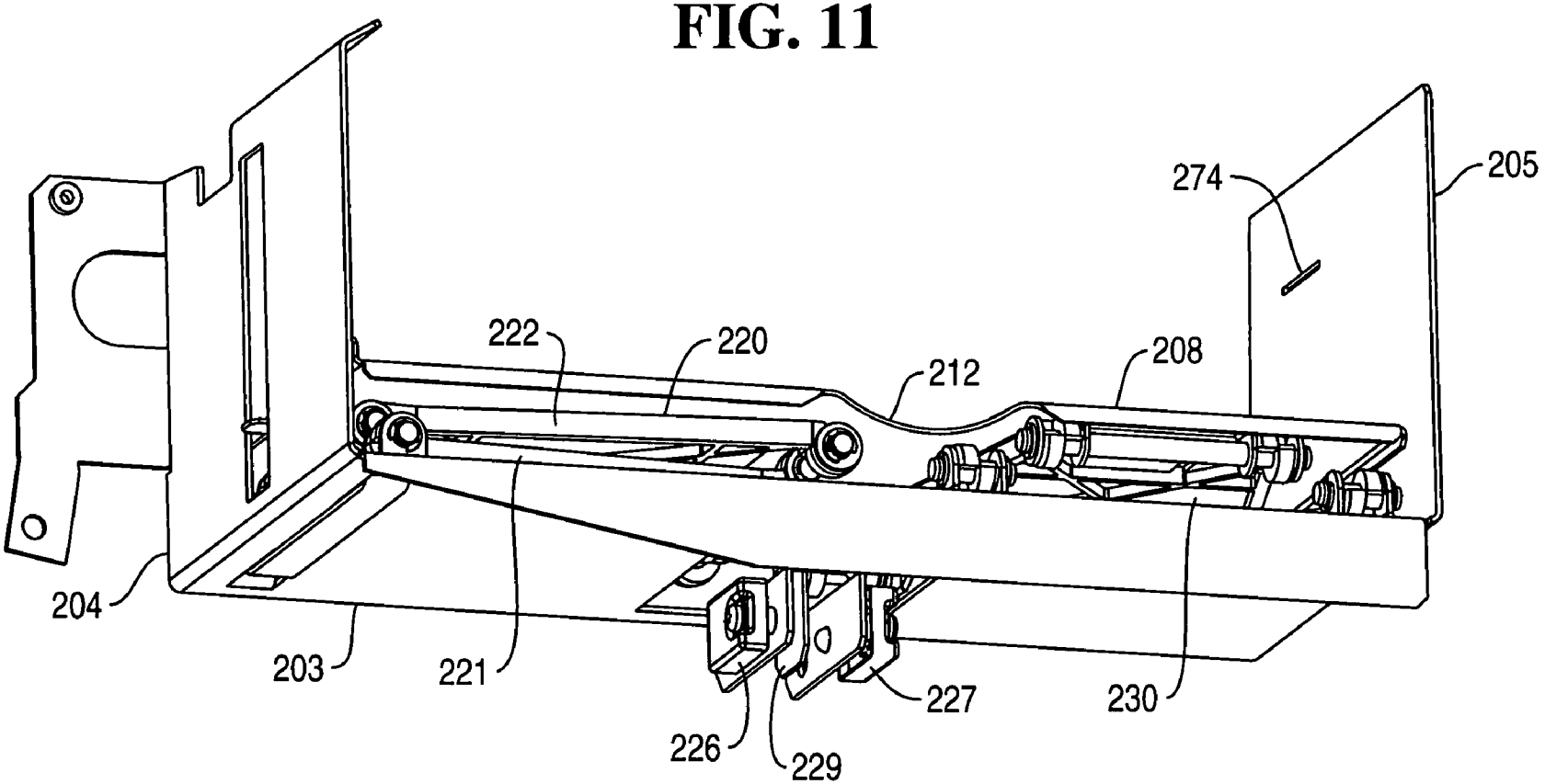
FIG. 11 is a view similar to FIG. 10, and showing parts in different positions.
Figure 12:
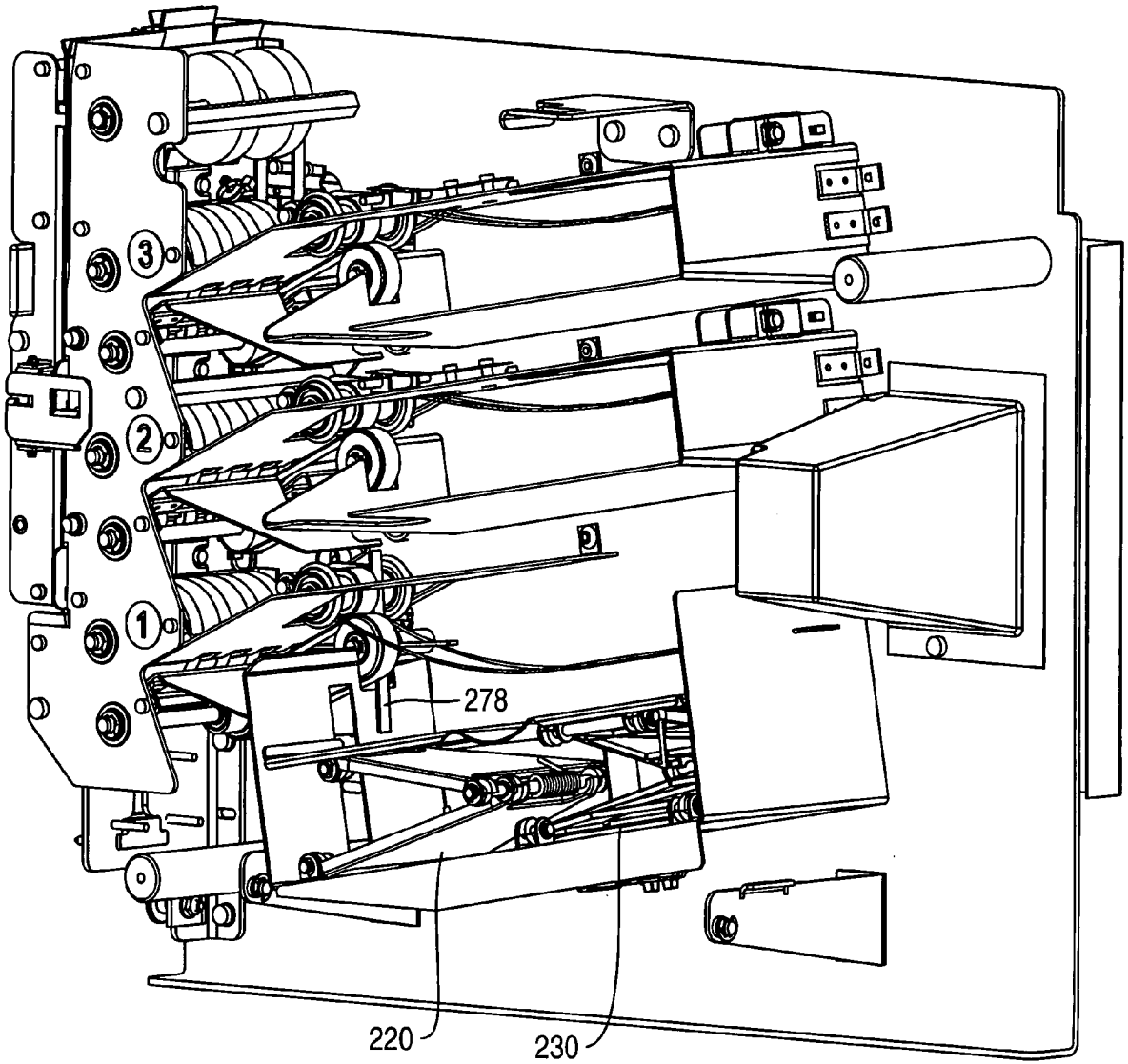
FIGS. 12 and 13 are views similar to FIG. 6, and showing parts in different positions.
Figure 13:
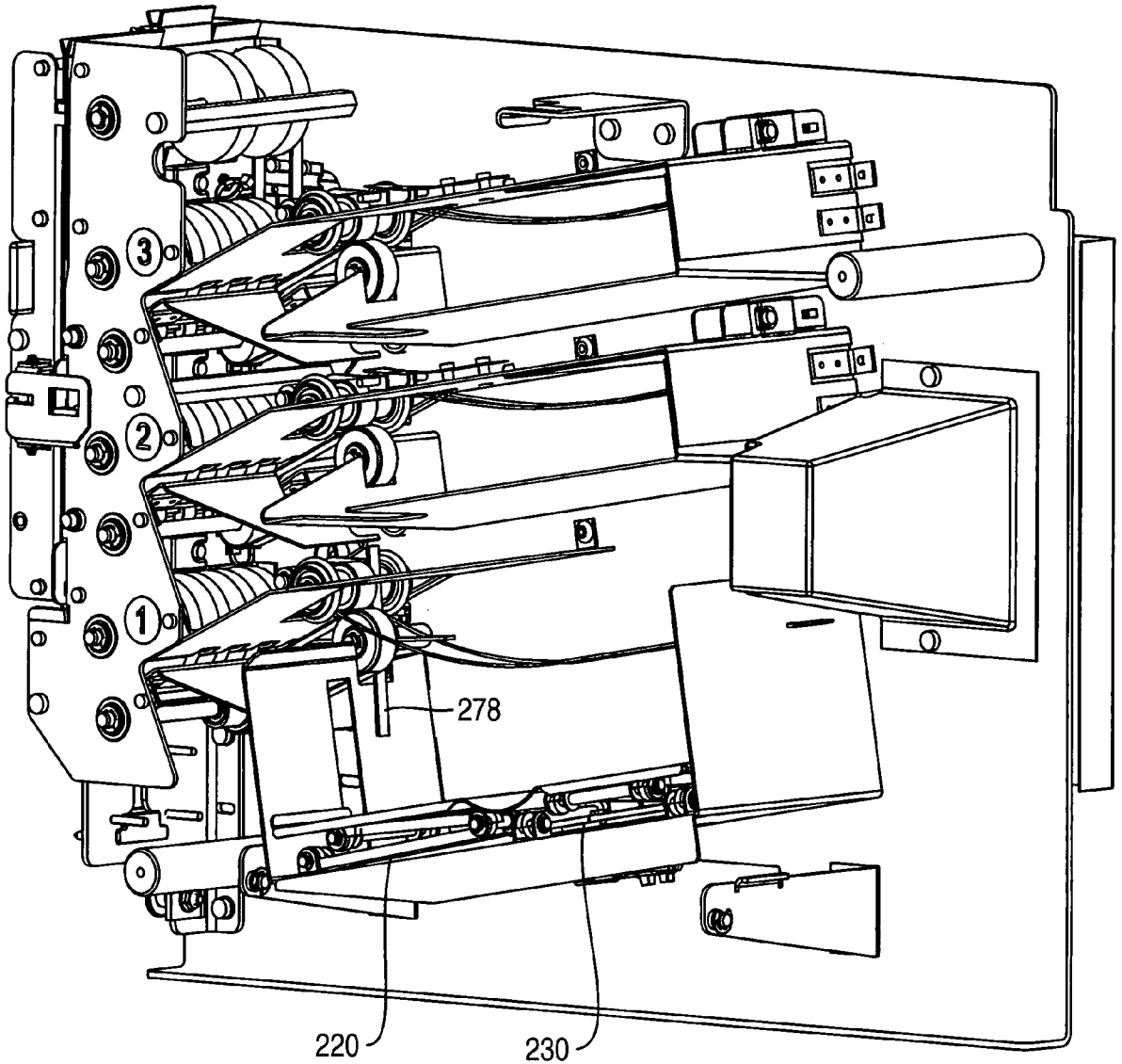

When a full stack of documents is on the top major surface 210 of the platform member 208, the weight of the stack of documents compresses the first and second biasing members 220, 230 to move the platform member 208 from the position shown in FIG. 10 to the position shown in FIG. 11. When the platform member 208 moves to the position shown in FIG. 11, the projecting member 229 moves between the LED 226 and the sensor 227 to interrupt light emitted from the LED to the sensor. This interruption of light provides a signal to indicate that there is full stack of documents on the top major surface 210 of the platform member 208. As shown in FIG. 12, the first and second biasing members 220, 230 are compressed about halfway. FIG. 13 shows the first and second biasing members 220, 230 as being completely compressed, and corresponds to the position of the platform member 208 illustrated in FIG. 11.

Figure 14:
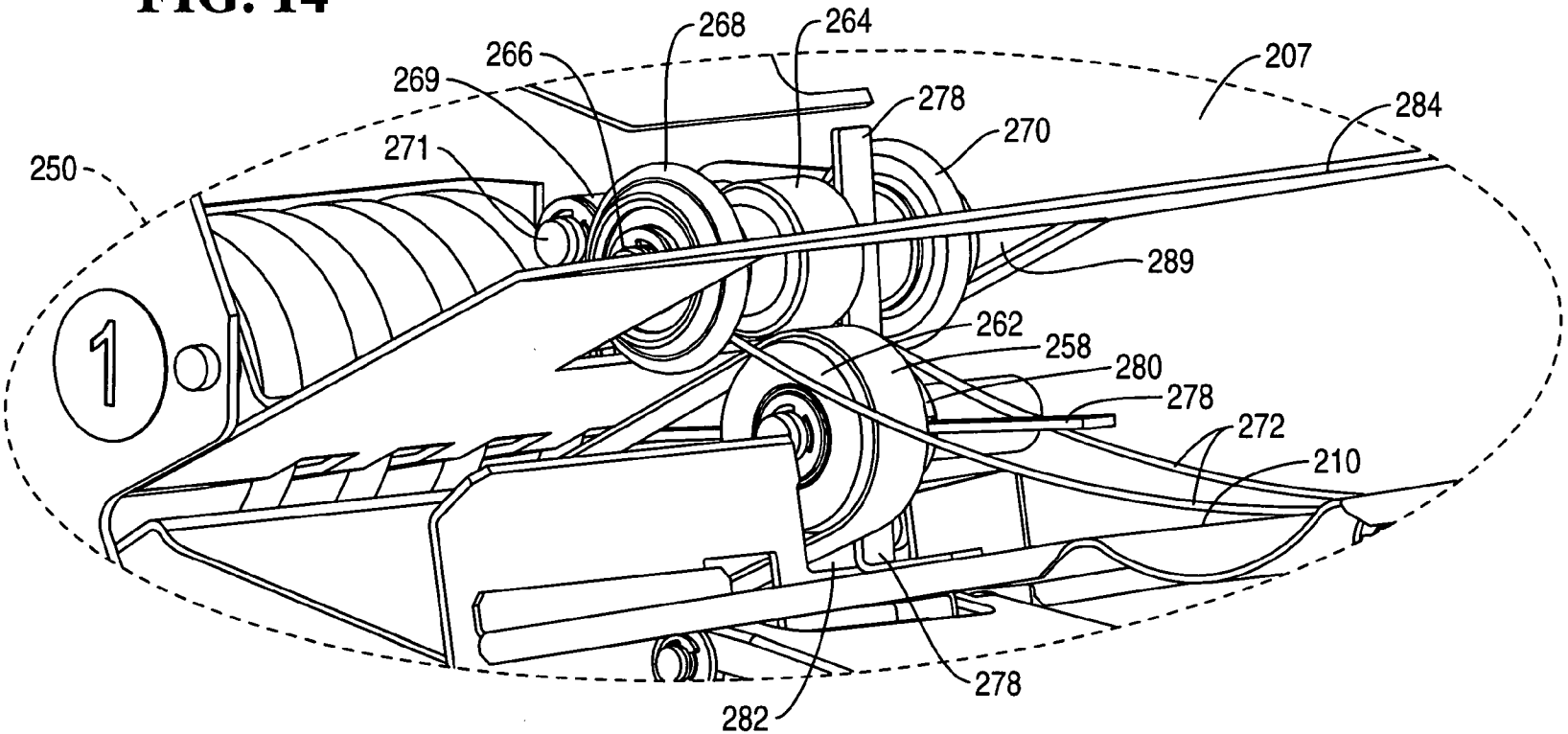
FIG. 14 is an enlargement of a portion of FIG. 6.
Figure 15:
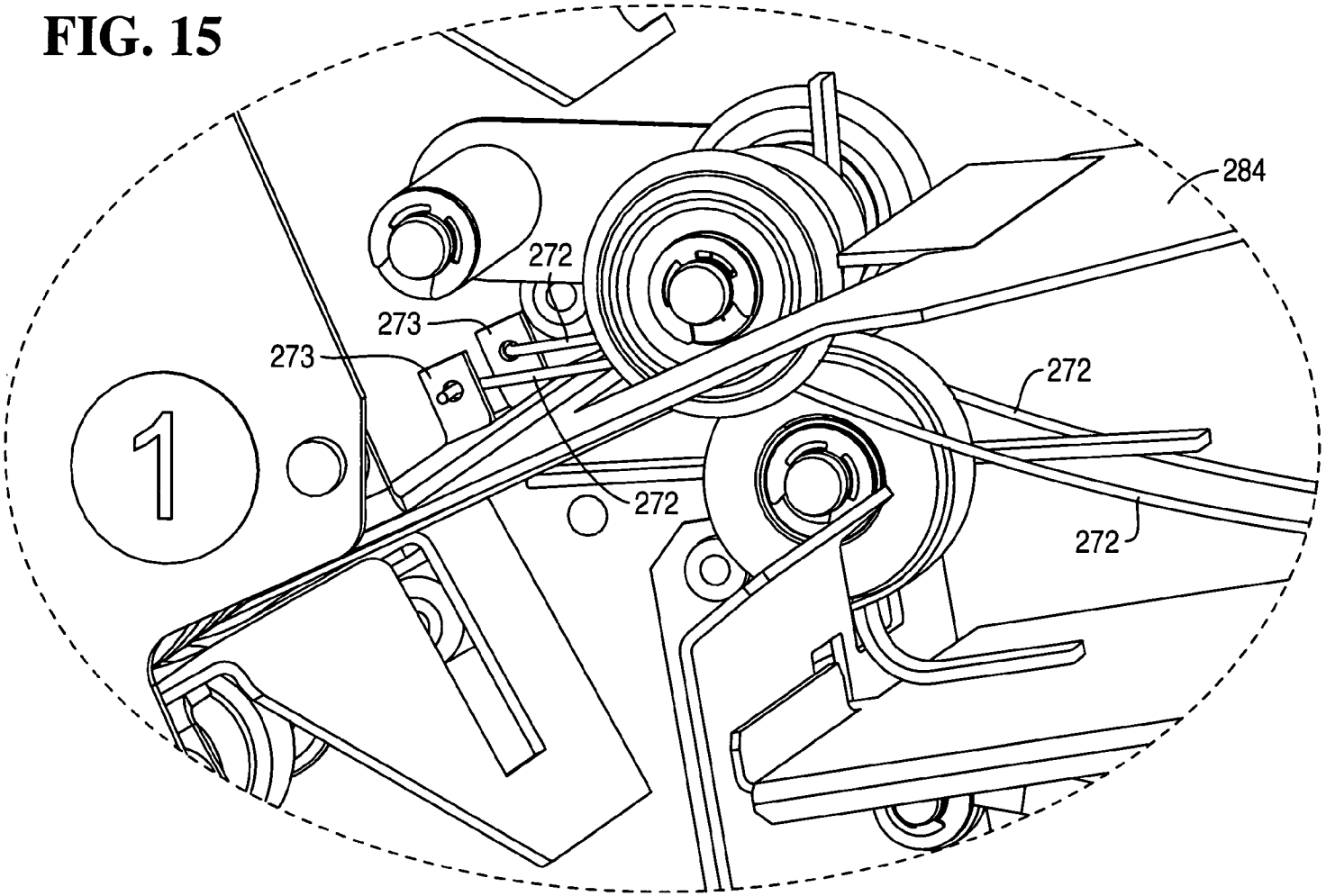
FIG. 15 is a perspective view looking slightly more from the left-side of FIG. 14.

A portion of FIG. 6, which portion is designated with reference numeral 250 in FIG. 6, is shown enlarged in FIG. 14. FIG. 15 is a perspective view looking slightly more from the left-side of FIG. 14, and shows certain parts not visible in FIG. 14. Referring again to FIG. 8, a document transport path 252 extends through a nip defined between a main drive roller 254 and a first idler roller 256. As shown in FIGS. 8 and 14, an endless drive belt 258 drivingly interconnects a first drive roller 260 (FIG. 8) and a second drive roller 262. A drive motor 263 (FIG. 6) drives the main drive roller 254 in a counter-clockwise direction (as viewed looking at FIG. 8). The drive motor 263 also drives the second drive roller 262 in a clockwise direction (also as viewed looking at FIG. 8) to rotate the drive belt 258 in the clockwise direction.

A second idler roller 264 (FIG. 14) is rotatable about a shaft 266 and abuts against the outer periphery (i.e., the outer circumferential surface) of the drive belt 258. A guide member 284 guides documents into the nip between the drive belt 258 and the second idler roller 264. A first cupping roller 268 is disposed at one end of the shaft 266, and a second cupping roller 270 is disposed at the other end of the shaft 266, as best shown in FIG. 14. The second cupping roller 270 is the same size as the first cupping roller 268. It is conceivable that the size of the second cupping roller 270 and the size of the first cupping roller 268 may be different. One end (not shown) of a bracket 269 is fixedly attached to the shaft 266, and the other end of the bracket is pivotally connected to a support shaft 271 which is fixedly attached to the base plate 207. A small torsion spring (not shown) biases the bracket 269 in the clockwise direction (as viewed looking at FIG. 8) about the support shaft 271. Thus, the bracket 269, the shaft 266, the second idler roller 264, and the first and second cupping rollers 268, 270 are pivotable together as a unit, and this unit is biased in the clockwise direction (as viewed looking at FIG. 8) about the support shaft 271.

A flexible wire 272 which is formed in a generally U-shape is suspended across the interior chamber 206, as best shown in FIGS. 7, 8, and 14. The flexible wire 272 is round in cross-sectional area. The bottom of the U-shape wire 272 extends through a slot 274 (FIGS. 7 and 8) in the end wall portion 205 and is supported in the slot for sliding movement along an axis 276 (FIGS. 7 and 8) which extends between the end wall portion 204 and the end wall portion 205. As shown in FIGS. 8 and 15, one end of one leg portion of the U-shape wire 272 is connected to one of a pair of bracket extensions 273, which extension is attached to the guide member 284. Similarly, the end of the other leg portion of the U-shape wire 272 is connected to the other one of the pair of bracket extensions 273, which extension is also attached to the guide member 284. Both leg portions of the U-shape wire 272 are suspended within the interior chamber 206 and between the two end wall portions 204, 205, as best shown in FIGS. 7 and 8. Each leg portion of the U-shape wire 272 has a kinked portion (not shown) which forms generally, wide V-shaped area and which is located just behind the first cupping roller 268 as viewed looking at FIG. 8.

Referring again to FIGS. 8 and 14, each of four flapper members 278 has one end thereof connected to the outer periphery of a central hub portion 280 (shown only in FIG. 14) of the second drive roller 262. Each of the flapper members 278 is made of relatively flexible material. Accordingly, when the second drive roller 262 is driven to rotate about its longitudinal central axis, the flapper members 278 also rotate about the longitudinal central axis of the second drive roller. Since each of the flapper members 278 is flexible, it curls and moves through an opening 282 (FIG. 14) in the end wall portion 204 when the second drive roller 262 rotates about its longitudinal central axis. One of the flapper members 278 (i.e., the one of the flapper members 278 which is near the bottom of the second drive roller 262 as shown in FIGS. 8 and 14) is curled and resting on the top major surface 210 of the platform member 208. In FIGS. 12 and 13, this same one of the flapper members 278 is extended since the platform member 208 is shown in a lowered position in each of these figures. Operation and function of the flapper members 278 will be described later.

Figure 16:
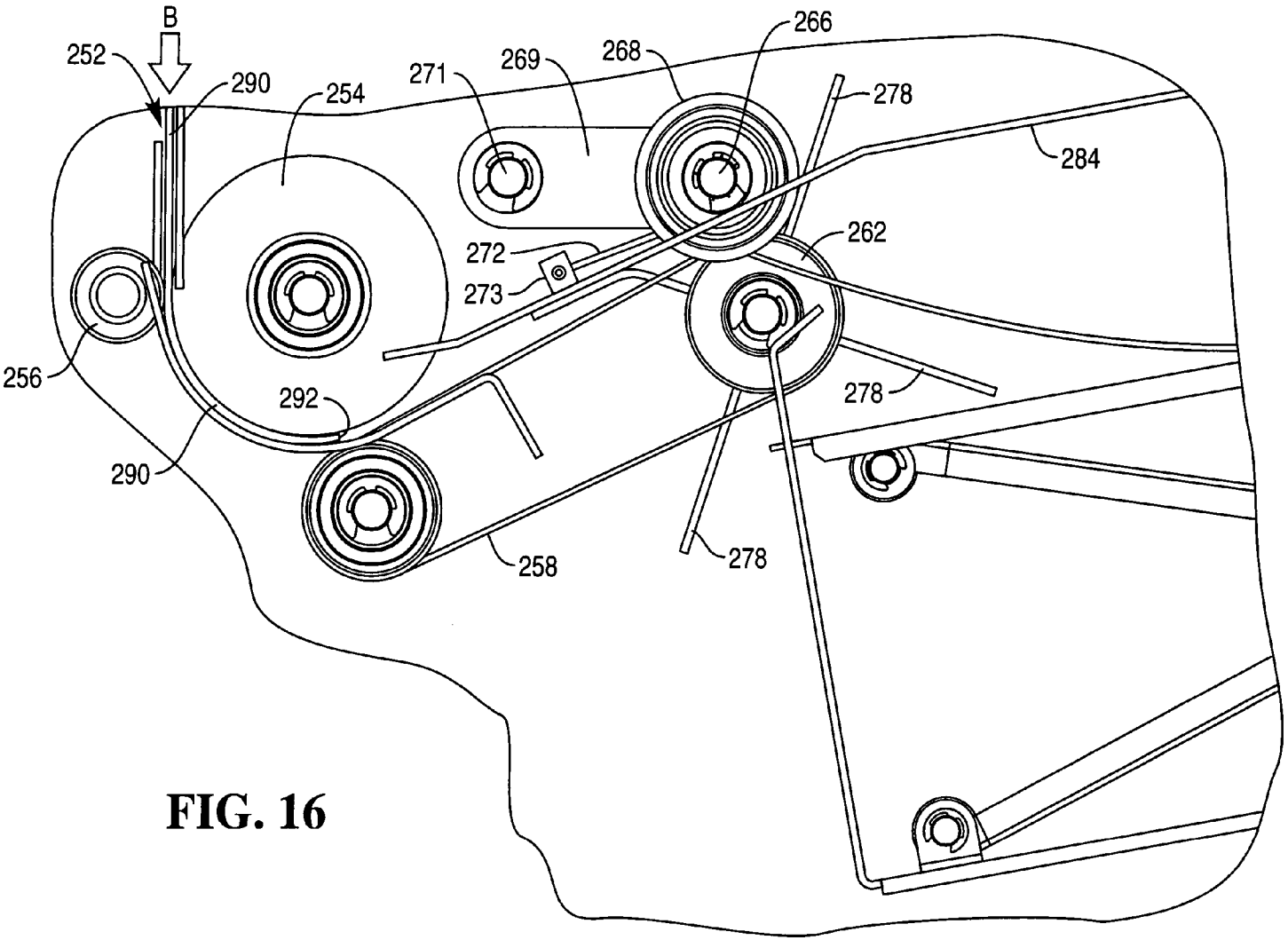
FIGS. 16–19 are enlarged views of a portion of FIG. 8, and showing a document which is being transported into the document stacker bin in different positions.
Figure 17:
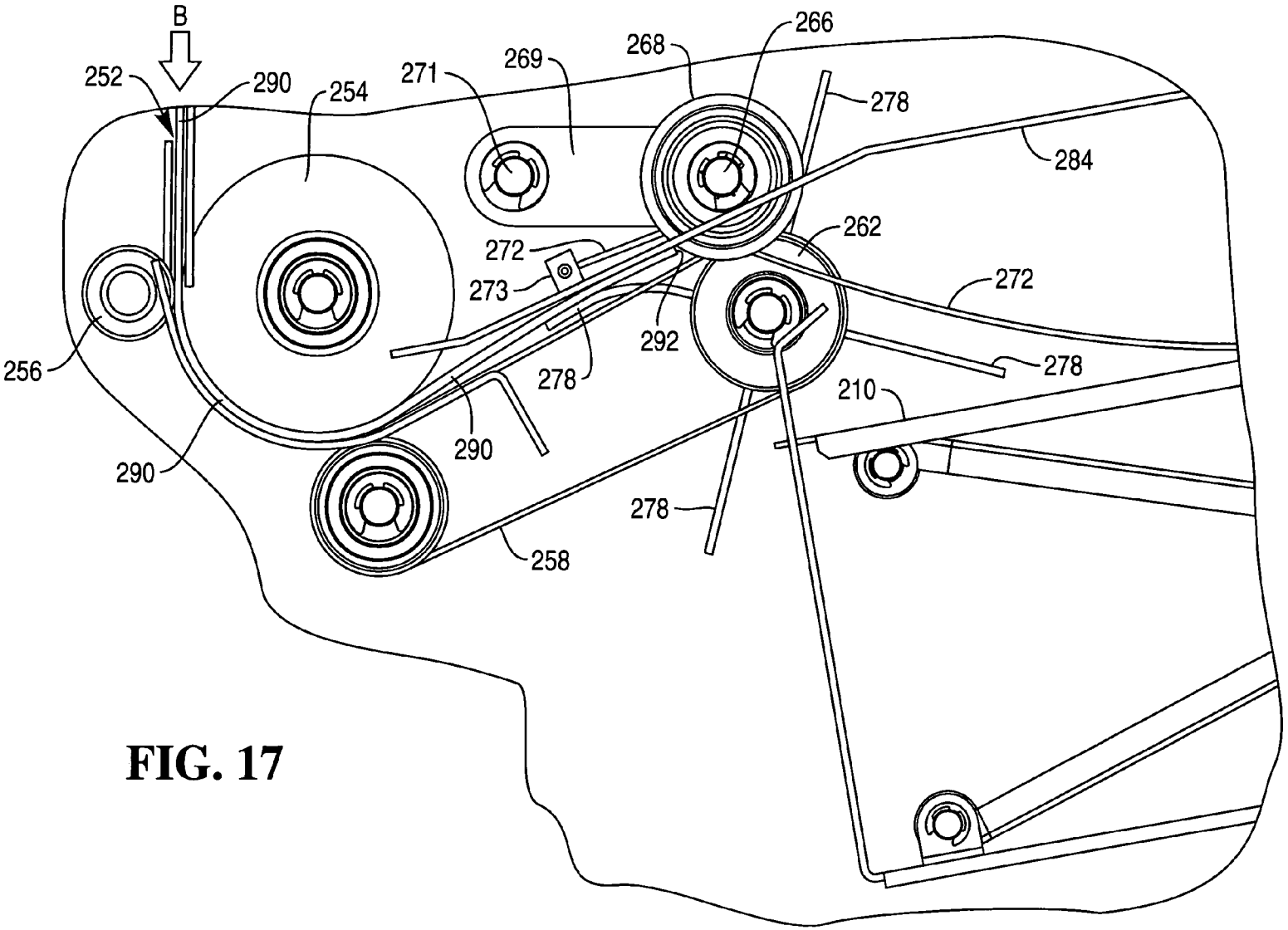

Referring to FIG. 16, a check 290 is fed along the document transport path 252 in the direction of arrow B into the nip between the main drive roller 254 and the first idler roller 256. The position of the flapper members 278 shown in FIG. 16 is different from the position of the flapper members shown in FIGS. 8 and 14 since the flapper members rotate with rotation of the second drive roller 262 about its longitudinal central axis. As shown in FIG. 16, the leading edge 292 of the check 290 is just about to enter the nip between the main drive roller 254 and the drive belt 258. As the check 290 continues to be transported in the direction of arrow B, the leading edge 292 of the check 290 is guided by the guide member 284 and moves from the position shown in FIG. 16 to the position shown in FIG. 17. In FIG. 17, the leading edge 292 of the check 290 is just about to enter the nip between the drive belt 258 and the second idler roller 264 (FIG. 14).

As the leading edge 292 enters the nip between the drive belt 258 and the second idler roller 264, the first and second cupping rollers 268, 270 engage the leading edge 292. The first and the second cupping rollers 268, 270 continue to engage the check 290 as the check 290 continues to be transported. The engagement between the check 290 and the first and second cupping rollers 268, 270 causes the check to stiffen and straighten as the check continues to be transported. One of the flapper members 278 is shown flexed and unable to extend straight due to presence of the guide member 284. However, as the second drive roller 262 continues to rotate in the clockwise direction, this one of the flapper members 278 eventually moves through an opening 289 (FIG. 14) and extends straight after it moves through the opening.

When the check 290 is in the position shown in FIG. 17, one of the flapper members 278 is shown flexed and unable to extend straight due to obstruction of the check 290. It should be noted that the four flapper members 278 flex and engage the underside of the check 290 as the check is being transported into nip between the drive belt 258 and the second idler roller 264. This occurs because of the flexibility of the flapper members 278 and the "clearance space" which is provided between the central hub portion 280 (FIG. 14) of the second drive roller 262 and the outer periphery of the drive belt 258. The flapper members 278 curl up in this clearance space as the check 290 enters the nip between the drive belt 258 and the second idler roller 264. The check 290 is stiffened and straightened by the first and second cupping rollers 268 as the check enters the nip between the drive belt 258 and the second idler roller 264.

Figure 18:
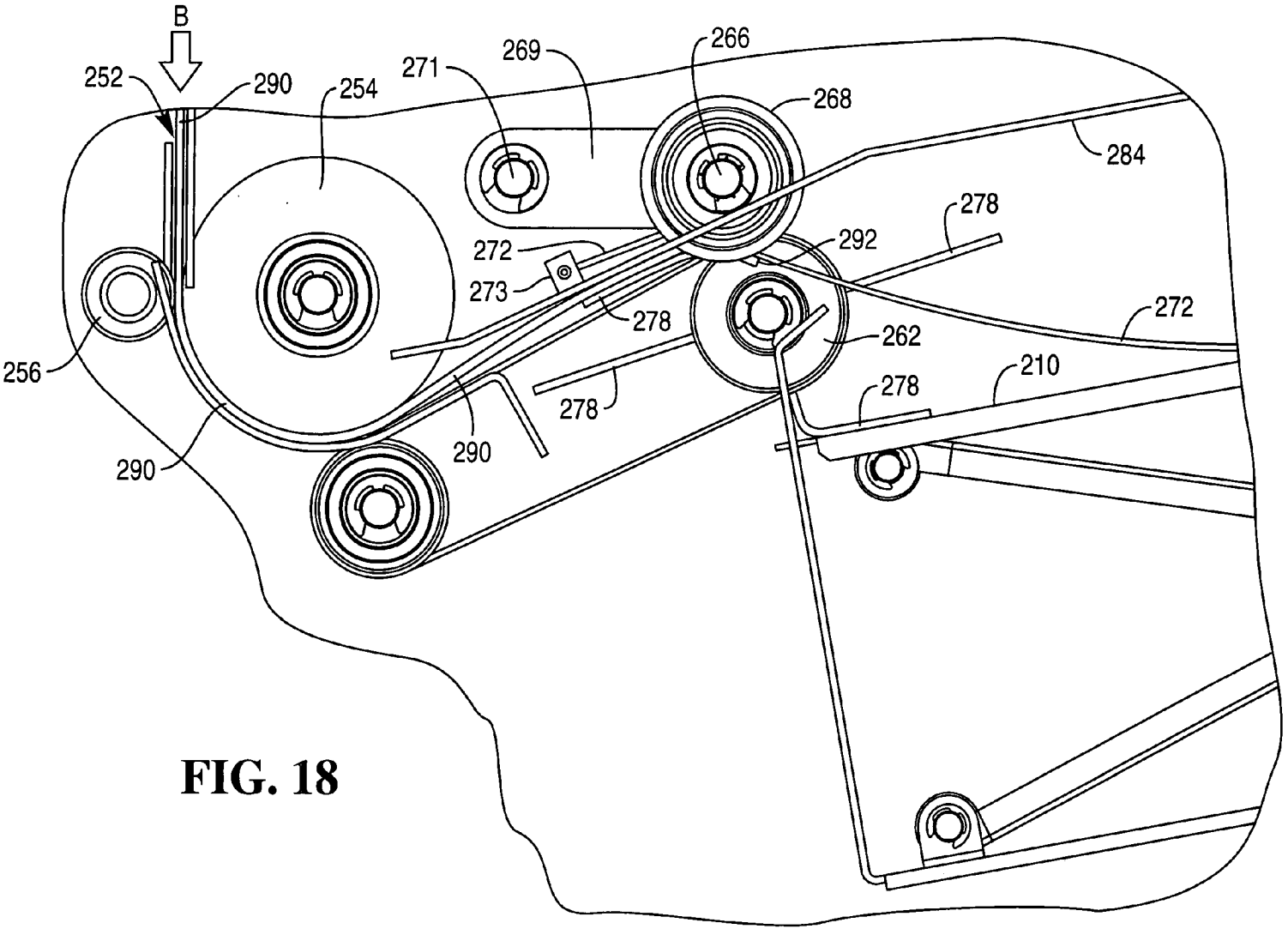
Figure 19:
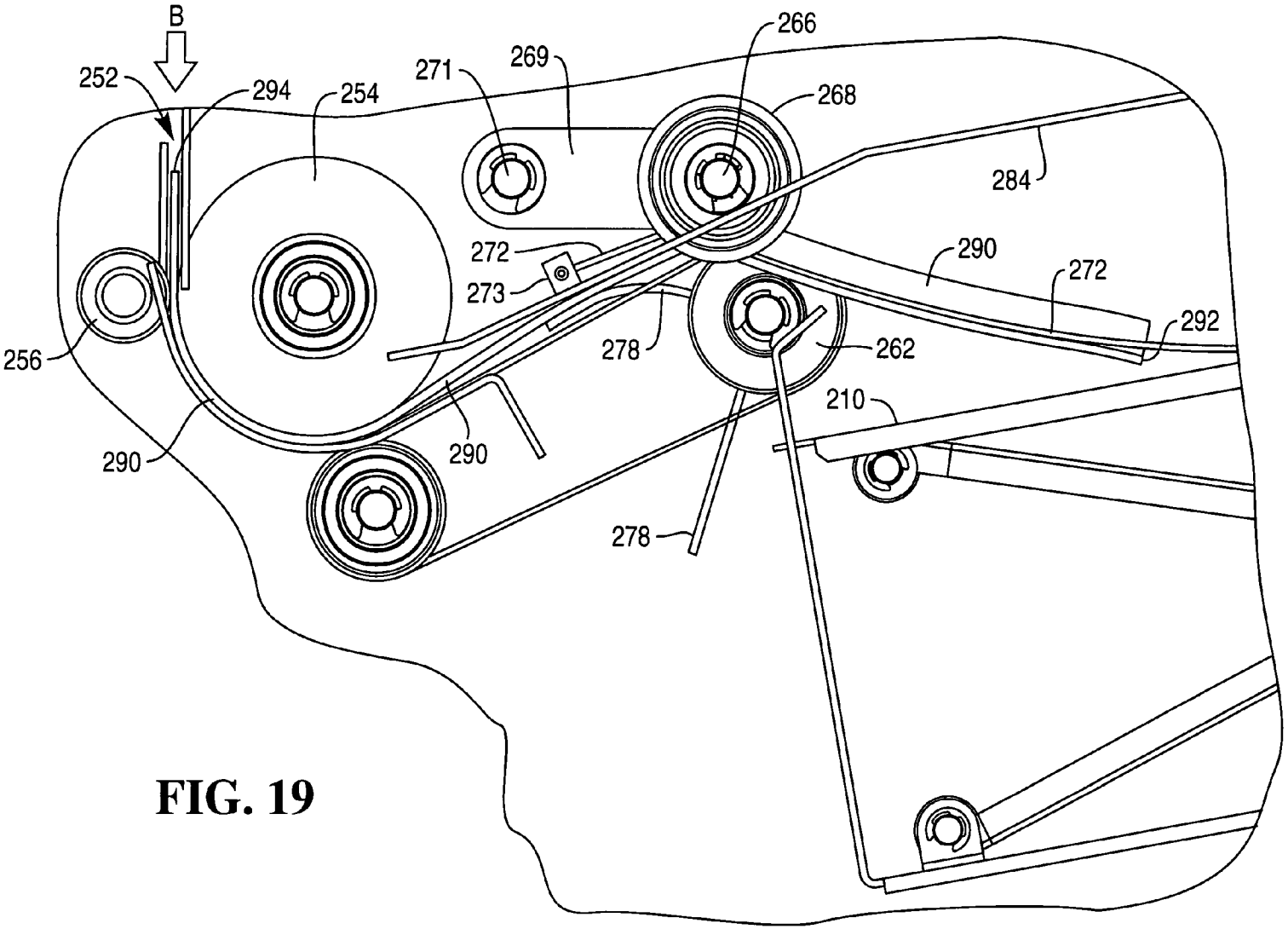

Eventually, the leading edge 292 of the check 290 moves into contact with the two leg portions of the U-shape flexible wire 272, as shown in FIG. 18. When this occurs, the two leg portions of the flexible wire 272 co-operate with each other and the first and second cupping rollers 268, 270 to continue causing the check 290 to stiffen and straighten as the check continues to be transported into the interior chamber 206. As the check 290 continues to be transported and stiffened and straightened by the actions and co-operation of the first and second cupping rollers 268, 270 and the flexible wire 272, the leading edge 292 of the check 290 moves from the position shown in FIG. 18 to the position shown in FIG. 19. In FIG. 19, the leading 292 of the check 290 is shown just about to move into contact with the top major surface 210 (or with the top of a previous check which has already been stacked) and into two contact patches between the two leg portions of the flexible wire 272 and the top major surface. Again, the position of the flapper members 278 shown in FIG. 19 is different from the position of the flapper members shown in FIG. 18 since the flapper members rotate with rotation of the second drive roller 262 about its longitudinal central axis.

Figure 20:
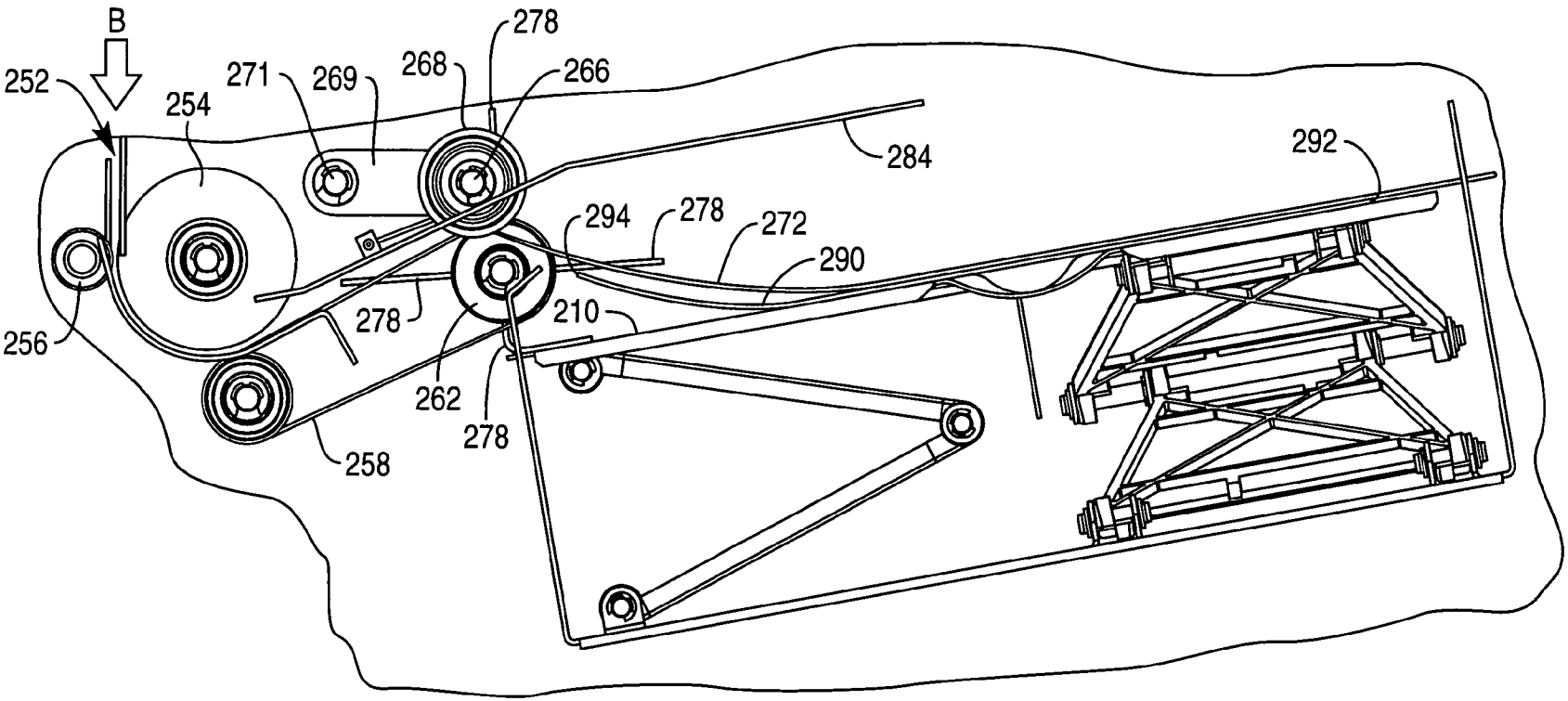
FIGS. 20 and 21 are views similar to FIG. 8, and showing a document which is being stacked in the document stacker bin in different positions.
Figure 21:
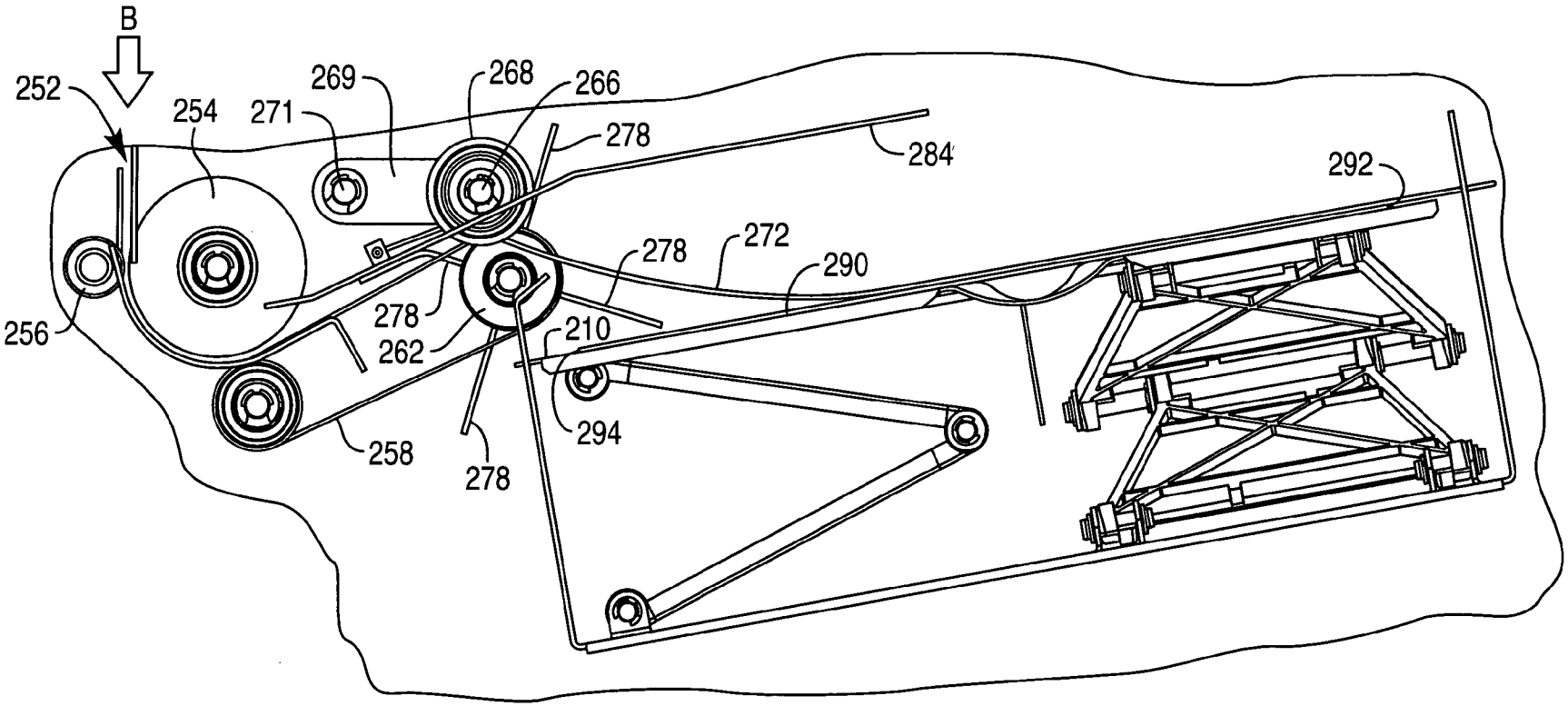

As the leading edge 292 of the check 290 moves into two contact patches between the flexible wire 272 and the top major surface 210, friction is created which tends to slow down movement of the check 290 in the direction in which it is moving. In this case, the movement of the check 290 into the interior chamber 206 is slowed down. Although the movement of the check 290 into the interior chamber 206 is slowed down by this frictional engagement, the driving force between drive belt 258 and the second idler roller 264 is sufficient to continue moving the check into the interior chamber from the position shown in FIG. 19 to the position shown in FIG. 20. In FIG. 20, the trailing edge 294 of the check 290 has just moved out of the nip between the drive belt 258 and the second idler roller 264. When this occurs, the frictional engagement between the top major surface 210 and the flexible wire 272 is sufficient to slow movement of the check 290 into the interior chamber 206 so that the check does not move too far into the interior chamber As previously described, the four flapper members 278 mounted to the central hub portion 280 (FIG. 14) of the second drive roller 262 rotate together with the second drive roller about the shaft 266. After the trailing edge 294 of the check 290 exits the nip between the drive belt 258 and the second idler roller 264 as shown in FIG. 20, the flapper members 278 eventually rotate around enough to flick the check in the vicinity of the trailing edge of the check. The flicking action of the flapper members 278 onto the trailing edge 294 of the check 290 causes the trailing edge portion of the check 290 to move from the position shown in FIG. 20 to the position shown in FIG. 21.

It should be apparent that the friction provided at the contact patches between the top major surface 210 (or the top of the previous check which has been stacked) and the two leg portions of the flexible wire 272 slows down movement of the check 290 as the check is being stacked. The slowing down of movement of the check 290 is needed so that the flapper members 278 will be able to reach the trailing edge 294 of the check to flick and move the trailing edge portion of the check from the position shown in FIG. 20 to the position shown in FIG. 21. Otherwise, if movement of the check 290 into the interior chamber 206 is not slowed down, the check moves too far into the interior chamber and the flapper members 278 will not be able reach the trailing edge 294 of the check to cause the trailing edge portion to move from the position shown in FIG. 20 to the position shown in FIG. 21. It is conceivable that the flicking action of the flapper members 278 on the trailing edge 294 of the check 290 may cause the trailing edge portion of the check to contact the endwall portion 204.

It should also be apparent that the chance of a deposited check being stacked out of sequence is reduced, and that the capacity of the stacker bin 200 is more fully utilized. Also, the tendency of a deposited check being crumpled against a previously deposited check is reduced. Further, the tendency of a deposited check being stacked underneath a previously deposited check is reduced. Thus, the chance of obtaining a stack of deposited checks without any stacking defect is increased.

Although the above-description describes the PERSONAS (™) 5878 NCR ATM embodying the present invention, it is contemplated that other models of ATMs, other types of ATMs, or other types of self-service terminals may embody the present invention. It is conceivable that the self-service terminal may be any type of device in a publicly accessible, unattended environment, such as a check depositing ATM, a check depositing/cashing ATM, a check cashing ATM, or the like. Self-service terminals are generally public-access devices that are designed to allow a user to conduct a transaction or to access information in an unassisted manner and/or in an unattended environment. Self-service terminals typically include some form of tamper resistance so that they are inherently resilient. Self-service terminals allow users to obtain information or to conduct a transaction. Self-service terminals include: ATMs; non-cash kiosks that allow users to access information (e.g., to view reward points on a reward card the user inserts into the self-service terminal); and kiosks that accept payment for services (e.g. Web surfing kiosks, kiosks that allow users to buy goods, etc.). The term self-service terminal has a relatively broad meaning and includes vending machines.

Also, although the above-description describes a financial document in the form of a check being deposited, it is contemplated other types of financial documents may be deposited. Moreover, it is conceivable that non-financial documents may be deposited. Documents may be of different sizes, different thicknesses, or different weights of paper. Also, although the above-description describes a check being deposited in its entire amount by an ATM customer (i.e., the user), it is contemplated that the check may be deposited only in partial amount of the entire amount of the check at the ATM 10, with the remaining amount of the check being cashed and delivered to the ATM customer.

Although the above-description describes the first and second cupping rollers 268, 270 as being of different diameters, it is conceivable that the first and second cupping rollers may be of the same diameter. Also, the diameter of the first cupping roller 268 may be larger than the diameter of the second cupping roller 270.

Also, although the above-description describes four flapper members 278, it is conceivable that the number of flapper members may be less or more than four. It is also conceivable that each of the flapper members may be of different lengths, different shapes, or different cross-sectional areas.

Further, although the above-description describes the cross-section of flexible wire 272 as being round, it is conceivable that the cross-section may be of a different shape so long as the flexible is able to cup a check to stiffen and straighten the check as the check is transported into the interior chamber 206 to be stacked. It is also conceivable that more than one wire be used, and that more than two wire portions extend between the end wall portions 204, 205.

It is also contemplated that the biasing members 220, 230 described hereinabove may be in any form so long as a biasing force maintains a relatively constant force between the platform member 208 and the leg portions of the flexible wire 272 as the interior chamber 206 fills up with checks. More specifically, the weight of the checks on the platform member 208 increases and the biasing members 220, 230 compress as the interior chamber 206 fills up with checks. As the biasing members 220, 230 compress, the biasing force provided by the biasing members increases to maintain a relatively constant force between the platform member 208 and the leg portions of the flexible wire 272. It is conceivable that any type of resilient members and any number of resilient members may be disposed underneath the platform member 208 to provide the biasing force to provide the necessary friction at the contact patches between the two leg portions of the flexible wire 272 and the topmost check on the stack when a check is being stacked on top of the topmost check.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A method of stacking documents in an interior chamber of a document stacker, the method comprising:

cupping a document at a first time to stiffen and straighten the document before the document is stacked in the interior chamber;

cupping the cupped document at a second time which is different from the first time to maintain the document stiff and straight as the document is being stacked in the interior chamber and thereby to reduce the chance of a stacking defect from occurring when a succeeding document is subsequently stacked on top of the document; and engaging a trailing edge of the document to urge the trailing edge of the document in a direction away from direction of movement of the document into the interior chamber and thereby to prevent a succeeding document which is to be subsequently stacked on top of the document from stacking out of sequence relative to the document.

2. A method according to claim 1, further comprising:

frictionally engaging the document as the document is being stacked in the interior chamber to prevent the document from moving too far into the interior chamber and thereby to allow the trailing edge of the document to be engaged and urged in the direction away from direction of movement of the document into the interior chamber.

3. A method of stacking documents in an interior chamber of a document stacker, the method comprising:

cupping a document to stiffen and straighten the document before the document is transported into the interior chamber to be stacked in the interior chamber;

cupping the cupped document to maintain the document stiff and straight as the document is being transported into the interior chamber and stacked in the interior chamber and thereby to reduce the chance of a succeeding document which is subsequently transported into the interior chamber from crumpling into the document; and engaging a trailing edge of the document to urge the trailing edge of the document in a direction away from direction of movement of the document into the interior chamber and thereby to prevent a leading edge of the succeeding document which is to be subsequently transported into the interior chamber from crumpling into the trailing edge of the document.

4. A method according to claim 3, further comprising:

frictionally engaging the document as the document is being transported into the interior chamber to prevent the document from moving too far into the interior chamber and thereby to allow the trailing edge of the document to be engaged and urged in the direction away from direction of movement of the document into the interior chamber.

5. A document stacker apparatus comprising:

means defining an interior chamber into which documents can be stacked and through which an axis extends from an upstream end of the interior chamber to a downstream end of the interior chamber;

first cupping means for cupping a document to stiffen and straighten the document before the document is transported into the interior chamber to be stacked in the interior chamber;

second cupping means for cupping the cupped document to maintain the document stiff and straight as the document is being transported into the interior chamber from the upstream end of the interior chamber towards the downstream end of the interior chamber and stacked in the interior chamber so as to reduce the chance of a stacking defect from occurring when a succeeding document is subsequently transported into the interior chamber and stacked on top of the document; and engaging means for engaging a trailing edge of the document to urge the trailing edge of the document in a direction away from the downstream end of the interior chamber so as to prevent a succeeding document which is to be subsequently transported into the interior chamber from stacking out of sequence relative to the document.

6. A document stacker apparatus according to claim 5, wherein the engaging means includes (i) a flapper roller rotatable about its longitudinal central axis, and (ii) a number of flapper members disposed circumferentially around the flapper roller such that the flapper members extend in a direction transverse to the longitudinal central axis of the flapper roller.

7. A document stacker apparatus according to claim 5, further comprising:

biasing means for co-operating with the second cupping means to provide friction for engaging the document as the document is being transported into the interior chamber to prevent the document from moving too far into the interior chamber so as to enable the engaging means to engage the trailing edge of the document and urge the trailing edge of the document in the direction away from the downstream end of the interior chamber.

8. A document stacker apparatus according to claim 7, wherein the second cupping means includes a pair of slack wires extending along the axis of the interior chamber.

9. A document stacker apparatus according to claim 8, wherein the biasing means includes (i) a platform member on which documents are supported when the documents are stacked in the interior chamber, and (ii) a number of resilient members disposed beneath the platfonn member such that the resilient members bias the platform member and any documents supported thereon towards the pair of slack wires to bias the document which is being transported onto the stack of documents against the pair of slack wires to frictionally engage the document as the document is being transported into the interior chamber to be stacked.

10. A document stacker apparatus comprising:

means defining an interior chamber into which documents can be stacked and through which an axis extends from an upstream end of the interior chamber to a downstream end of the interior chamber;

first cupping means for cupping a document to stiffen and straighten the document before the document is transported into the interior chamber to be stacked in the interior chamber; and second cupping means for cupping the cupped document to maintain the document stiff and straight as the document is being transported into the interior chamber from the upstream end of the interior chamber towards the downstream end of the interior chamber and stacked in the interior chamber so as to reduce the chance of a stacking defect from occurring when a succeeding document is subsequently transported into the interior chamber and stacked on top of the document;

wherein the first cupping means includes a pair of cupping rollers having a common longitudinal central axis which extends transverse to the axis of the interior chamber.

11. A document stacker apparatus according to claim 10, wherein the second cupping means includes a pair of slack wires disposed between the pair of cupping rollers and extending along the axis of the interior chamber within the interior chamber such that (i) the pair of cupping rollers cup the document to stiffen and straighten the document before the document is transported into the interior chamber, and (ii) the pair of slack wires subsequently cup the document to maintain the document stiff and straight as the document is being transported into the interior chamber.

12. A method of operating an automated teller machine (ATM) comprising:

receiving a check from an ATM customer;

reading a magnetic ink character recognition (MICR) codeline from the check;

endorsing the check;

transporting the endorsed check to a stacker bin;

cupping the check to stiffen and straighten the check as the check is being transported into the stacker bin;

cupping the cupped check to maintain the check stiff and straight as the check is being stacked on top of other checks already stacked in the stacker bin so as to reduce the chance of a succeeding check which is subsequently transported into the stacker bin from stacking out of sequence; and flicking a trailing edge of the check to urge the trailing edge of the check in a direction away from direction of movement of the check into the stacker bin so as to prevent a leading edge of the succeeding check which is to be subsequently transported into the stacker bin from either crumpling into the trailing edge of the check or stacking underneath the check.

13. A method according to claim 12, further comprising:

frictionally engaging the check as the check is being transported into the stacker bin to prevent the check from moving too far into the stacker so as to allow the trailing edge of the check to be flicked and urged in the direction away from direction of movement of the check into the stacker bin.

* * * * *

UNITED STATES PATENT AND TRADEMARK OFFICE

CERTIFICATE OF CORRECTION

PATENT NO. : 7,207,493 B2
APPLICATION NO. : 11/016788
DATED : April 24, 2007
INVENTOR(S) : F. B. Dunn and A. J. Boon It is certified that error appears in the above-identified patent and that said Letters Patent is hereby corrected as shown below:

Column 13, Line 32, after “the” delete “platfonn” and insert --platform--.

Column 13, Line 45, after “document” first occasion, delete “oefore” and insert --before--.

Signed and Sealed this

Sixth Day of November, 2007

JON W. DUDAS
*Director of the United States Patent and Trademark Office*